US007981336B2

(12) United States Patent
Pourdeyhimi

(10) Patent No.: US 7,981,336 B2
(45) Date of Patent: Jul. 19, 2011

(54) PROCESS OF MAKING MIXED FIBERS AND NONWOVEN FABRICS

(75) Inventor: Behnam Pourdeyhimi, Cary, NC (US)

(73) Assignee: North Carolina State University, Raleigh, NC (US)

( * ) Notice: Subject to any disclaimer, the term of this patent is extended or adjusted under 35 U.S.C. 154(b) by 398 days.

(21) Appl. No.: 12/184,773

(22) Filed: Aug. 1, 2008

(65) Prior Publication Data

US 2009/0042475 A1 Feb. 12, 2009

Related U.S. Application Data

(60) Provisional application No. 60/953,564, filed on Aug. 2, 2007.

(51) Int. Cl.

| | |
|---|---|
| ***D01D 5/30*** | (2006.01) |
| ***D01D 5/32*** | (2006.01) |
| ***D01D 5/36*** | (2006.01) |
| ***D01D 5/42*** | (2006.01) |
| ***D04H 3/02*** | (2006.01) |

(52) U.S. Cl. ..... 264/103; 264/147; 264/171.1; 264/172.11; 264/172.13; 264/172.14; 264/211.16

(58) Field of Classification Search ..... 264/103, 264/147, 171.1, 172.11, 172.13, 172.14, 264/172.15, 172.17, 211.16
See application file for complete search history.

(56) References Cited

U.S. PATENT DOCUMENTS

| | | | | |
|---|---|---|---|---|
| 4,612,228 | A | 9/1986 | Kato et al. | |
| 5,466,410 | A | 11/1995 | Hills | |
| 5,551,588 | A | 9/1996 | Hills | |
| 5,575,063 | A | 11/1996 | Hodan et al. | |
| 5,620,644 | A | 4/1997 | Hodan et al. | |
| 5,783,503 | A | 7/1998 | Gillespie et al. | |
| 6,448,462 | B2 | 9/2002 | Groitzsch et al. | |
| 6,455,156 | B1 | 9/2002 | Tanaka et al. | |
| 6,964,931 | B2 | 11/2005 | Carlyle | |
| 2002/0094741 | A1 | 7/2002 | Carlyle et al. | |
| 2004/0045145 | A1 * | 3/2004 | Wang et al. | 28/168 |
| 2005/0176326 | A1 * | 8/2005 | Bond et al. | 442/335 |
| 2006/0292355 | A1 | 12/2006 | Pourdeyhimi et al. | |

FOREIGN PATENT DOCUMENTS

WO WO 2007/002387 1/2007

OTHER PUBLICATIONS

Database WPI Week 199224, Thomson Scientific, London, 1992-196307; JP 04 126845 (Chisso Corp.),Apr. 27, 1992.

* cited by examiner

*Primary Examiner* — Leo B Tentoni
(74) *Attorney, Agent, or Firm* — Womble Carlyle Sandridge & Rice, PLLC

(57) ABSTRACT

The subject matter disclosed herein relates generally to the production of a predetermined ratio of multicomponent fibers in combination with monocomponent fibers or other multicomponent fibers, preferably through a spunbonding process. After extrusion, these fibers can produce a fiber network that is subsequently bonded to produce a nonwoven fabric comprising multiple types of fibers. The multicomponent fibers within the network may be processed to remove one component by dissolution or to split the individual components into separate fibers. As a result, the fabric will be comprised of fibers with a range of diameters (micro- or nano-denier fibers as well as higher denier fibers) such that the fibers will not pack as tightly as in a homogeneous nonwoven fabric produced from one type of monocomponent or multicomponent fiber. The present invention additionally relates to methods for producing nonwoven fabrics with increased loft, breathability, strength, compressive properties, and filtration efficiency.

25 Claims, 30 Drawing Sheets

PROCESS OF MAKING MIXED FIBERS AND NONWOVEN FABRICS

CROSS-REFERENCE TO RELATED APPLICATIONS

The present invention claims priority to U.S. Provisional Patent Application No. 60/953,564, filed Aug. 2, 2007, which is incorporated herein by reference in its entirety.

FIELD OF THE INVENTION

The invention relates generally to the manufacture of mixed fibers and nonwoven products manufactured from such fibers.

BACKGROUND OF THE INVENTION

Nonwoven spunbonded fabrics are used in many applications and account for the majority of products produced in or used in North America in the areas of healthcare, hygiene and disposable consumer products, and in industrial applications such as automotive, filtration, geotextiles, and other demanding applications requiring an engineered product. Almost all such applications require a lightweight, disposable fabric. Therefore, most spunbonded fabrics are designed for single use and are designed to have adequate properties for the applications for which they are intended. Spunbonding refers to a process where the fibers (filaments) are extruded, cooled, and drawn and subsequently collected on a moving belt to form a fabric. The web thus collected is not bonded and the filaments must be bonded together thermally, mechanically, or chemically to form a fabric. Thermal bonding is by far the most efficient and economical means for forming a fabric. Hydroentangling is not as efficient, but leads to a much more flexible and normally stronger fabric when compared to thermally bonded, single component fabrics.

Micro-denier fibers are fibers which are smaller than 1 denier. Typically, micro-denier fibers are produced utilizing a bicomponent fiber which is split. FIG. 1 illustrates the best known type of splittable fiber, commonly referred to as "pie wedge" or "segmented pie." U.S. Pat. No. 5,783,503 illustrates a typical meltspun multicomponent thermoplastic continuous filament which is split after mechanical treatment. In the configuration described, it is desired to provide a hollow core filament. The hollow core prevents the tips of the wedges of like components from contacting each other at the center of the filament and promotes separation of the filament components.

In these configurations, the components are segments typically made from nylon and polyester. It is common for such a fiber to have 16 to 24 segments. The conventional wisdom behind such a fiber has been to form a web of typically 2 to 3 denier per filament fiber by means of carding and/or airlay, and to subsequently split and mechanically bond the fibers into a fabric in a single step by subjecting the web to high pressure water jets. The resultant fabric will be composed of micro-denier fibers and will possess all of the characteristics of a micro-denier fabric with respect to softness, drape, cover, and surface area.

When manufacturing bicomponent fibers for splitting, several characteristics of the fibers must typically be considered to ensure that the desired continuous fibers may be adequately manufactured. These characteristics include the miscibility of the components, differences in melting points, crystallization properties, viscosity, and the ability to develop a triboelectric charge. The selection of copolymers is typically done so as to ensure that these characteristics between the bicomponent fibers are accommodating and allow for the multicomponent filaments to be spun. Suitable combinations of polymers include polyester and polypropylene, polyester and polyethylene, nylon and polypropylene, nylon and polyethylene, and nylon and polyester. Since these bicomponent fibers are spun in a segmented cross-section, each component is exposed along the length of the fiber. Consequently, if the components selected do not have properties which are closely analogous, the continuous fiber may suffer defects during manufacturing such as breaking or crimping. Such defects may render the filament unsuitable for further processing.

U.S. Pat. No. 6,448,462 discloses another multicomponent filament having an orange-like multisegment structure representative of a pie configuration. This patent also discloses a side-by-side configuration. In these configurations, two incompatible polymers such as a polyester and a polyethylene or polyamide are utilized for forming a continuous multicomponent filament. These filaments are melt-spun, stretched, and directly laid down to form a nonwoven material. The use of this technology in a spunbond process coupled with hydrosplitting has now produced a commercially available product marketed under the EVOLON® trademark by Freudenberg. This nonwoven fabric is used in such applications as cloths and wipes, curtains and shades, sound absorption drapes, bed linens, printing media, and clothing including synthetic leather. More recently, such fabrics have been used a wall coverings.

The segmented pie is only one of many possible splittable configurations. In the solid form, it is easier to spin, but in the hollow form, it is easier to split. To ensure splitting, dissimilar polymers are utilized. But even when polymers with low mutual affinity are chosen, the fiber's cross section can have an impact on how easily the fiber will split. The cross section that is most readily splittable is a segmented ribbon, such as that shown in FIG. 2. The number of segments in a segmented ribbon has to be odd so that the same polymer is found at both ends so as to "balance" the structure. This fiber is anisotropic and is difficult to process as a staple fiber. As a filament, however, it would work fine. Therefore, in the spunbonding process, this fiber can be attractive. Processing is improved in fibers such as tipped trilobal or segmented cross, the structures of which are illustrated in FIG. 3.

Another method of creating micro-denier fibers utilizes multicomponent fibers of the islands in the sea configuration, as shown in FIG. 4. U.S. Pat. No. 6,455,156 discloses one such structure. In an islands in the sea configuration, a primary fiber component, the sea, is utilized to envelope smaller interior fibers, the islands. Such structures provide for ease of manufacturing, but require removal of the sea in order to reach the islands. This is done by dissolving the sea in a solution which does not impact the islands. Such fibers with islands in the sea configurations are commercially available today. They are most often used in making synthetic leathers, suedes, and specialty wipes. In the case of synthetic leathers, a subsequent step introduces coagulated polyurethane into the fabric, and may also include a top coating. Another end use that has resulted in much interest in such fibers is in technical wipes, where the small fibers lead to a large number of small capillaries, resulting in better fluid absorbency and better dust pickup. For a similar reason, such fibers may be of interest in filtration.

However, in all of the nonwoven materials produced from such microfibers or nanofibers as those discussed above, the overall fabric structures are rather dense and compact. The result is that the nonwoven materials are not sufficiently breathable, and often have insufficient strength for certain applications. Additionally, these materials often do not have adequate tear and tensile properties. These densified structures are therefore often not suitable for some critical applications including aerosol filtration, apparel, and thermal insulation.

Accordingly, there is a need for a manufacturing process that can produce micro- and nano-denier nonwoven materials that are breathable and less dense, and which have higher bulk than typically found in commercially available fabrics.

There are processes and apparatus designs disclosed in the prior art describing the production of multicomponent filaments and fibers and the preparation of nonwoven fabrics from more than one type of fiber. For example, U.S. Pat. Nos. 5,620,644 and 5,575,063 describe a spinpack designed to produce bicomponent filaments via the melt spinning of two liquid polymer streams. U.S. Pat. Nos. 5,551,588 and 5,466,410 describe a spinneret designed to produce multicomponent filaments that have irregular polymer distribution and are non-circular in cross-section. U.S. Pat. No. 6,964,931 discloses a method for simultaneously providing distributed monocomponent and/or multicomponent filaments through a spunbond process to produce a filament web that can be bonded to provide a nonwoven fabric.

While it is known in the art to provide alternating layers of different types of filaments from a spunbond process, and also to simultaneously form multicomponent and monocomponent filaments from a single spinneret, there is a need for additional processes that will produce a nonwoven fabric having higher bulk and less density than the aforementioned materials.

SUMMARY OF THE INVENTION

The invention provides a method for producing continuous filaments, and fabrics made therewith, wherein the fabrics produced can exhibit improved flexibility, breathability, compression resilience, strength, and filtration and thermal properties. The mixed fiber fabrics of the present invention are comprised of a first group of multicomponent filaments in combination with either monocomponent filaments or a second group of multicomponent filaments having one or more components of different size relative to the first group of multicomponent filaments. The first group of multicomponent filaments includes components, such as segments or islands, sized to provide micro-denier filaments upon splitting of the multicomponent filaments or dissolution of certain components of the multicomponent filaments. The monocomponent filaments or second group of multicomponent filaments are sized to provide larger denier filaments as compared to the filament sizes of the first group of multicomponent fibers (e.g., larger micro-denier filaments or filaments sized above the micro-denier size range).

In one embodiment, the invention provides a method of producing a nonwoven fabric, comprising simultaneously melt spinning a set of fibers comprising a first group of multicomponent fibers, wherein at least one component of each of the first group of multicomponent fibers is sized to provide a micro-denier filament, and a second group of fibers, the second group of fibers configured to provide filaments having a larger size than filaments of the first group of multicomponent fibers and wherein the second group of fibers comprises monocomponent fibers or multicomponent fibers having at least one component sized differently relative to the components of the multicomponent fibers; and collecting the melt-spun set of fibers.

In certain embodiments, the first group of multicomponent fibers is configured to provide a plurality of micro-denier filaments by dissolution of at least one fiber component or splitting of the multicomponent fiber into separate filaments. For example, the first group of multicomponent fibers can be segmented fibers or islands in the sea fibers adapted for splitting by application of mechanical force. Alternatively, the first group of multicomponent fibers comprises islands in the sea fibers comprising a soluble sea component that can be dissolved to release a plurality of island filaments having a micro-denier size.

Both the first and groups of fibers can comprise multicomponent fibers that are segmented fibers, the first group of multicomponent fibers having a larger number of segments than the second group of multicomponent fibers. In another example, the first and second groups of fibers comprise islands in the sea fibers, the first group of multicomponent fibers having a larger number of islands than the second group of multicomponent fibers.

In various embodiments, a method of producing a nonwoven fabric according to the invention can comprise simultaneously melt spinning a set of fibers comprising a first fiber type and a second fiber type. In some embodiments, the method comprises simultaneously melt spinning a set of fibers comprising a first fiber type and a second fiber type. The first fiber type can particularly comprise a bicomponent fiber formed to provide a plurality of fibers, at least one of which is less than about 1 denier in size. The plurality of fibers can be formed by splitting or fibrillating the bicomponent fiber or by chemically removing (e.g., dissolving) one component of the fiber. The second fiber type can comprise at least one fiber that is greater than about 1 denier in size, including a monocomponent filament that are greater than about 1 denier in size or a multicomponent fiber formed to provide a plurality of individual filaments, a least one of which is greater than about 1 denier in size. The method can further comprise collecting the melt-spun set of fibers.

In specific embodiments, the first fiber type can be an islands in the sea fiber, such as one formed with a soluble sea component that dissolves to release a plurality of island filaments, at least one of which is less than about 1 denier in size. Preferably, each island filament can be less than about 1 denier in size. The second fiber type can comprise at least one fiber that is greater than about 1 denier in size. The method can further comprise collecting the melt-spun set of fibers.

In some embodiments, the second fiber type can comprise a bicomponent fiber. For example, the bicomponent fiber can be a segmented fiber that disassociates into a plurality of individual segments. Such individual segments can preferentially be greater than about 1 denier in size. Specifically, each individual segment of the segmented fiber can have a filament diameter of at least about 2 μm.

In other embodiments, the second fiber type can comprise a monocomponent fiber. In such embodiments, it is preferable for the monocomponent fiber, in some embodiment, to have a diameter of at least about 5 μm.

The island filaments from the first fiber type can also have specific sizes. For example, in some embodiments, each of the plurality of island filaments can have a diameter of less than about 1 μm. Preferably, each of the island filaments can have a diameter of about 0.2 μm to about 0.8 μm.

In specific embodiments, the second fiber type can also be an islands in the sea fiber and can be formed with a soluble sea component that dissolves to release a plurality of island filaments. Preferably, each island filament from the second fiber type can have a size that is greater than the size of the filaments from the first fiber type. Likewise, the islands in the sea fiber of the first fiber type can comprise a greater number of islands than the islands in the sea fiber of the second fiber type. For example, the number of islands in the first and second fiber types can be present at a ratio of at least about 2:1 or at least about 10:1.

The method of the invention can further include the steps of forming the melt-spun set of fibers into a nonwoven fiber web, and mechanically and/or thermally bonding the nonwoven fiber web.

In another aspect, the invention provides staple fibers and continuous filaments comprising the set of fibers described above, as well as yarns and fabrics (e.g., knit, woven, braided, or nonwoven) made using the fibers of the invention. In one preferred embodiment, the fabric of the invention is a spunbonded nonwoven fabric that is hydroentangled and/or thermally bonded.

In another aspect, the invention further provides a variety of spunbond fabric and fiber webs useful in the preparation of nonwoven, spunbond fabrics. In particular, the invention can comprise fabrics prepared according to any of the methods disclosed herein.

In certain embodiments, the invention provides a nonwoven fabric comprising two fiber types. The nonwoven fabric can particularly be a spunbond, nonwoven fabric. Preferably, the two fiber types are distinguishable in that the first fiber type comprises a multicomponent fiber that, when appropriately treated, provides a plurality of individual filaments less than about 1 denier in size. The appropriate treatment can be by splitting or fibrillating or by dissolving one component of the multicomponent fiber (which may particularly be a bicomponent fiber). The first fiber type may comprise a plurality of individual filaments less than about 1 denier in size that are derived from a multicomponent fiber. The second fiber type can comprise at least one fiber that is greater than about 1 denier in size. In specific embodiments, the second fiber type comprises at least about 20% by weight of the fabric. The second fiber type may particularly comprise a monocomponent fiber. The second fiber type may comprise a multicomponent fiber that splits into a plurality of individual filaments greater than about 1 denier in size.

BRIEF DESCRIPTION OF THE DRAWINGS

The methods and systems designed to carry out the invention will hereinafter be described, together with other features thereof. The invention will be more readily understood from a reading of the following specification and by reference to the accompanying drawings forming a part thereof.

DETAILED DESCRIPTION OF THE INVENTION

Figure 1:
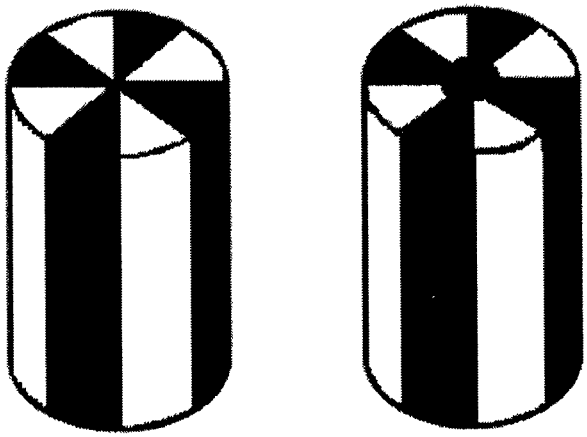
FIG. 1 is a schematic cross-sectional view of typical bicomponent segmented pie fibers, solid (left) and hollow (right)
Figure 2:
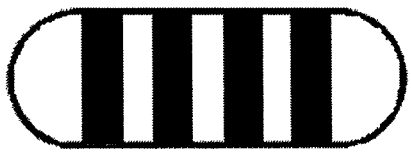
FIG. 2 is a schematic cross-sectional view of a typical segmented ribbon fiber.
Figure 3:
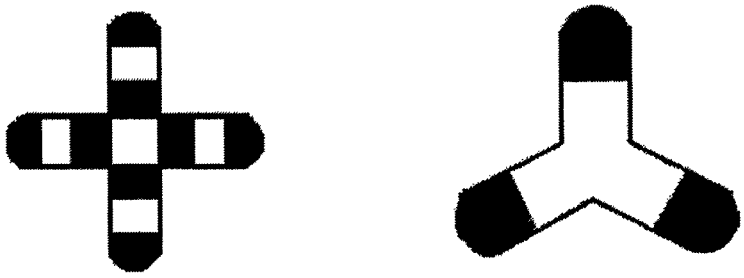
FIG. 3 is a schematic cross-sectional view of typical segmented cross and tipped trilobal fibers.
Figure 4:
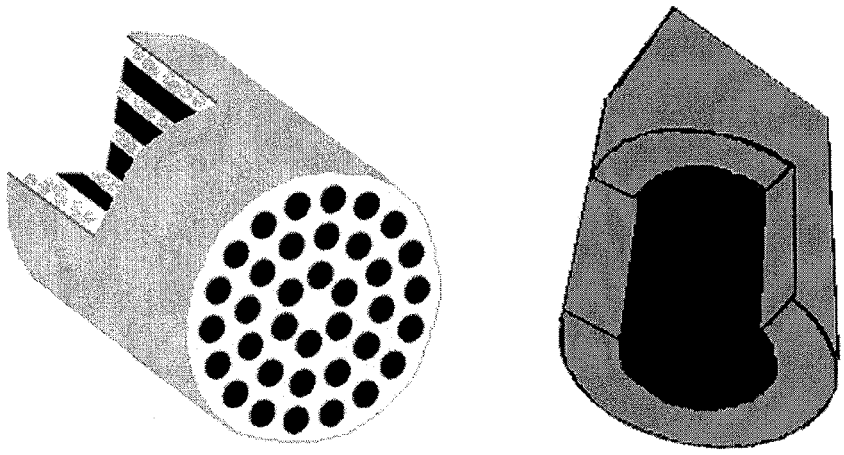
FIG. 4 is a schematic cross-sectional view of a typical islands in the sea fiber (left) and a sheath/core fiber (right)

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The subject matter disclosed herein relates to a method for producing continuous filaments and fabrics from those filaments which can exhibit improved flexibility, breathability, compression resilience, strength, and filtration and thermal properties. The basis for the invention is the combination of a first multicomponent filament (or a plurality of such filaments) with a second dissimilar multicomponent filament or a monocomponent filament (or plurality of such filaments).

In particular, the invention relates to a method for producing spunbonded nonwoven materials wherein multiple fiber configurations are provided in the same fiber grouping (i.e., from the same spinneret assembly). The resulting nonwoven fiber structure will be composed of a combination of multicomponent micro- or nano-denier fibers with higher denier monocomponent or multicomponent fibers. The resulting nonwoven fabric will thus be composed of fibers with varying diameters, and can provide improved thermal insulation and filtration properties than commercially available fabrics. The fabrics of the invention, in certain embodiments, will also be stronger and more breathable than other conventional nonwoven materials.

The fabrics of the invention can include a plurality of fiber types (or groups), wherein each fiber type may be a single monocomponent or bicomponent filament or may be a plurality of monocomponent filaments, bicomponent filaments, or mixtures of monocomponent and bicomponent filaments. A first fiber type can comprise a multicomponent fiber configuration, meaning the fiber or fibers comprise two or more polymers combined in an ordered configuration, such as islands in the sea, segmented pie, segmented ribbon, tipped trilobal, side-by-side, sheath-core, or segmented cross. Exemplary islands in the sea fibers that can be used in the invention include those fibers set forth in U.S. Pat. Appl. Pub. No. 2006/0292355 to Pourdeyhimi et al., which is incorporated by reference herein. The multicomponent fibers used in the invention can also comprise the type of multilobal fibers set forth in U.S. Pat. Appl. Pub. No. 2008/0003912 to Pourdeyhimi et al., which is incorporated by reference herein. Preferably, the multicomponent fibers exhibit a fiber configuration adapted for producing micro-denier fibers through mechanical splitting or dissolution of a portion of the fiber.

The fabrics of the invention will also include a second fiber type, which again can be a single fiber or a plurality of fibers. The fibers of the second fiber type are preferably dissimilar in structure from the fibers of the first fiber type. The second fiber type can also be in a multicomponent form, including any of the multicomponent forms noted as useful for the first fiber type. The multicomponent fibers of the second fiber type will preferably differ from the first group in the size of the filaments contained within the fibers, such as the size of the island components of an islands in the sea fiber or the size of the segments of a segmented pie or segmented ribbon fiber. Typically, the difference in size will be accomplished by altering the number of segments or islands of the second group of multicomponent fiber as compared to the first group. In other words, the second group of multicomponent fibers will have a different number of islands, in the case of an islands in the sea fiber, or a different number of segments, in the case of a segmented pie or segmented ribbon fiber. Alternatively, the second group of fibers can be monocomponent fibers; however, it is noted that the present invention does not require the presence of monocomponent fibers. Instead, in certain embodiments, the present invention provides a plurality of fibers in the absence of monocomponent fibers, meaning all fibers are multicomponent in configuration. In certain embodiments, the second group of fibers will provide fibers that are not micro-denier in size, meaning the monocomponent fibers or multicomponent fibers of the second group are comprised of fiber components greater than 1 denier in size.

Additional groups of dissimilar fibers could also be introduced into the fabrics of the invention, meaning the fabrics could include a third group of fibers comprising, for example, a third group of islands in the sea fibers having a different number of islands as compared to the first and second groups.

Note that each group of fibers can comprise a mixture of different fiber types, such as a mixture of segmented fibers and islands in the sea fibers. For example, the first group of multicomponent fibers could be a mixture of segmented pie and islands in the sea fibers, where the segments of the pie and the island filaments are sized to provide micro-denier sized filaments. The second group of fibers could also comprise a mixture of different fiber types, such as a mixture of segmented fibers and islands in the sea fibers, or a mixture of sheath-core fibers and tipped multilobal fibers.

The relative number of fibers from each group can vary depending on the desired properties of the resulting fabric. For example, both the first and second group of fibers can comprise from about 1 to about 99% of the total number of fibers exiting a particular spinneret. Typically, one group of fibers will be present in an amount of about 5 to about 50% of the total number of fibers, and the other group will be present in an amount of about 50 to about 95%. In one embodiment, one group is present in an amount of 20% to about 50% and the other group is present in an amount of about 50% to about 80%. Where three distinct fiber groupings are present in the fabric, the relative amount of each can vary. For example, each group can be present in an amount of about 1% to about 80%, more typically about 5% to about 66%, and most often about 10% to about 50%.

In specific embodiments, the fabric can be characterized by the weight percentage of the fibers present that are not micro-denier fibers, relative to the total weight of the fabric. Specifically, when monocomponent fibers are used, a fabric according to the invention can comprise at least 10% by weight, at least 15%, at least 20%, at least 25%, at least 30%, at least 35%, at least 40%, at least 45%, or at least 50% by weight of the monocomponent fiber. In certain embodiments, the monocomponent fiber may comprise about 10% to about 60% by weight, about 15% to about 60%, about 20% to about 60%, about 25% to about 60%, about 30% to about 60%, about 20% to about 50%, about 25% to about 50%, or about 25% to about 40% by weight of the overall fabric.

The multiple groups of fibers having dissimilar structure can be mixed into a fabric structure in a variety of ways, depending on the application. For example, the various groups of fibers could be organized into rows or configured in other formations by simply adjusting the design of the spinpack. The spinpack distributes molten streams of the desired polymers to a spinneret, which is constructed of thousands of orifice openings through which the resulting combination of different multicomponent filaments or combination of multicomponent and monocomponent filaments are extruded.

The different sized fibers (i.e., different fiber groups) can be arranged in rows where the larger fibers are in the middle of two layers of smaller fibers. Alternatively, the different sized fibers are arranged in a random configuration. In yet another embodiment, the different sized fibers are arranged in rows where the smaller fibers are in the middle of two layers of larger fibers. Any combination of rows of fibers of the first type alternating with rows of fibers of the second type may be used according to the invention.

The fabrics of the invention can be expected to provide both good strength and compressive resilience properties due to the presence of the larger denier fibers within the structure and good insulation and filtration properties due to the presence of the micro-denier fibers.

In one embodiment of the invention, the first group of multicomponent fibers comprises islands in the sea fibers and the second group of fibers comprises monocomponent fibers, such as monocomponent fibers constructed of the same polymer as the islands or the sea of the islands in the sea fibers. The solid, monocomponent fibers can have any cross-sectional shape, including circular, oval, multilobal, and the like.

In another embodiment, the first group of multicomponent fibers comprises islands in the sea fibers and the second group of fibers also comprises islands in the sea fibers, wherein the two groups of fibers differ in the number of islands. For example, the first group could have greater than about 400 islands in each fiber and the second group could have less than about 300 islands in each fiber. Alternatively, the first group could have more than about 100 islands in each fiber and the second group could have less than about 20 islands in each fiber. Particular embodiments include 300/600 island combinations (i.e., 300 island fibers and 600 island fibers), 300/16 island combinations, 600/16 island combinations, 100/300 island combinations, and the like. The fabrics may include a third group of islands in the sea fibers having a third number of islands different from the number of islands in the first and second groups. Particular embodiments include 600/300/18 island combinations, 600/300/100 island combinations, 18/50/100 island combinations, and the like.

In yet another embodiment, the first group of multicomponent fibers are segmented fibers (e.g., segmented ribbon, segmented pie, segmented cross, and the like) having a first number of segments and the second group of fibers are segmented fibers having a second number of segments different from the number of segments in the first group. For example, the first group can comprise fibers having more than about 10 segments and the second group can have less than about 8 segments. Exemplary segment combinations include 32/16 segment combinations, 16/8 segment combinations, 4/8 segment combinations, 16/4 combinations, and the like. Three or more groups of segmented fibers having different numbers of segments can also be used, such as 32/16/4 combinations, 16/8/4 combinations, and the like.

In a further embodiment, the first group of multicomponent fibers are segmented fibers (e.g., segmented ribbon, segmented pie, segmented cross, and the like) having a first number of segments and the second group of fibers are monocomponent fibers, such as monocomponent fibers comprising one of the polymers used in the segmented fibers of the first group. The solid, monocomponent fibers can have any cross-sectional shape, including circular, oval, multilobal, and the like.

Even more specific examples of the invention include fabrics constructed of the following fiber groupings:

(a) 50% islands in the sea fibers with 300 islands and 50% islands in the sea fibers with 18 islands;

(b) 70% islands in the sea fibers with 300 islands and 30% monocomponent fibers made of the same polymer as the islands;

(c) 80% islands in the sea fibers having 600 islands and 20% monocomponent fibers made of the same polymer as the sea component of the islands in the sea fibers;

(d) 30% islands in the sea having 300 islands, 30% islands in the sea fibers having 600 islands, and remainder being islands in the sea fibers having 18 islands;

(e) 50% segmented pie fibers having 16 segments and 50% segmented pie fibers having 4 segments;

(f) 50% segmented pie fibers having 16 segments and 50% monocomponent fibers constructed of a polymer used in the segmented pie fibers; and (g) 30% segmented pie fibers having 4 segments, 30% segmented pie fibers having 16 segments, and the remainder being segmented pie fibers having 32 segments.

Fibers for use according to the present invention can have diameters ranging from about 0.1 μm to about 25 μm. Monocomponent fibers may have diameters of at least about 4 μm, at least about 5 μm, at least about 6 μm, at least about 8 μm, at least about 10 μm, at least about 12 μm, or at least about 15 μm. Monocomponent fibers can particularly have diameters in the range of about 10 μm to about 25 μm, about 12 μm to about 20 μm, or about 15 μm to about 20 μm. Similarly, bicomponent fibers prior to disassociation can have diameters in the range of 10 μm to about 25 μm, about 12 μm to about 20 μm, or about 15 μm to about 20 μm. Beneficially, the bicomponent fibers of the invention can be disassociated to form fibers having much smaller diameters. For example, segmented fibers (e.g., pie/wedge fibers) can be disassociated into individual filaments having diameters in the range of about 1 μm to about 5 μm, about 1 μm to about 4 μm, about 1 μm to about 3 μm, about 1 μm to about 2 μm. Island in the sea fibers according to the invention can have even smaller diameters. For example, after removal of the sea component, an I/S fiber according to the invention can provide individual filaments having diameters of less than about 2 μm, less than about 1 μm, or less than about 0.8 μm. In other embodiments, the individual filaments have diameters in the range of about 0.1 μm to about 5 μm, about 0.15 μm to about 3 μm, about 0.2 μm to about 2 μm, about 0.2 μm to about μ1 μm, or about 0.2 μm to about 0.8 μm.

In some embodiments, such as where an islands in the sea fiber is mixed with a segmented fiber, it may be useful for the individual segments of the segmented fiber to have sizes that are greater than the sizes of the individual filaments formed by the freed islands after disassociated from the sea component. In one embodiment, the individual filaments formed by the freed islands can have sizes of less than about 1 denier, and the individual segments of the segmented fiber can have sizes of greater than about 1 denier. In further embodiments, the individual filaments formed by the freed islands can have diameters as described above, and the individual segments of the segmented fiber can have greater diameters. For example, the individual segments of the segmented fiber can have a diameter of at least about 2 μm, at least about 3 μm, at least about 4 μm, at least about 5 μm, at least about 6 μm, at least about 7 μm, or at least about 8 μm. In specific embodiments, the individual segments of the segmented fiber can have a diameter in the range of about 2 μm to about 8 μm, about 2 μm to about 6 μm, or about 3 μm to about 6 μm.

In further embodiments, such as where a first islands in the sea fiber is mixed with a second islands in the sea fiber, it is beneficial for the plurality of island filaments released from the first fiber to be greater in size than the plurality of island filaments released from the second fiber. In specific embodiments, this can be achieved by providing a first fiber with a greater number of islands than in the second fiber. For example, the fibers can be formed based on a ratio of the number of islands in each fiber type. For example, in certain embodiments, the number of islands in each fiber type is at a ratio of at least about 2:1, meaning the first fiber type has two islands for every one island in the second fiber type. In further embodiments, the ratio of islands in the first fiber type to islands in the second fiber type is at least about 3:1, at least about 4:1, at least about 5:1, at least about 10:1, at least about 12:1, at least about 15:1, at least about 20:1, at least about 25:1, at least about 30:1, at least about 40:1, or at least about 50:1. In specific embodiments, the ratio is about 2:1 to about 50:1, about 5:1 to about 40:1, about 10:1 to about 40:1, or about 15:1 to about 30:1.

In particular embodiments, the invention provides a mixed filament spunbond fabric comprising a first fiber type and a second fiber type. The first fiber type can comprise a segmented, bicomponent fiber having a cross-section such that each individual segment has a size as described herein (particularly less than about 2 μm, less than about 1.5 μm, or less than about 1 μm). The first fiber type can comprise an islands in the sea bicomponent fiber having a cross-section such that each individual island has a size as described herein (particularly less than about 2 μm, less than about 1 μm, or less than about 0.8 μm). The second fiber type can comprise a monocomponent fiber having a size as described herein (particularly greater than about 2 μm, greater than about 3 μm, or greater than about 5 μm). Preferentially, the monocomponent fiber comprises at least about 20% by weight of the fibers in the fabric.

In other embodiments, the first fiber type can comprise a plurality of individual filaments each having a size of less than about 2 μm, less than about 1 μm, or less than about 0.8 μm. The second fiber type can comprise a monocomponent fiber having a size as described herein (particularly greater than about 2 μm, greater than about 3 μm, or greater than about 5 μm). Such fabrics may be one or both of hydroentangled (as described herein) and thermally bonded (as described herein).

After extrusion, the web of fibers forming the nonwoven fabric can be subjected to further processing techniques, such as techniques useful to improve mechanical bonding (e.g., needle punching, hydroentangling), thermal bonding (e.g., calendaring), steam jet bonding, or any other bonding envisioned by those skilled in the art, as well as combinations of the above bonding techniques. The inventive processes thus produce a final nonwoven material with a precise set of fibers of varying diameter. In some preferred embodiments, the fabric consisting of fibers of varying diameter can be point bonded for further strength.

Figure 5:
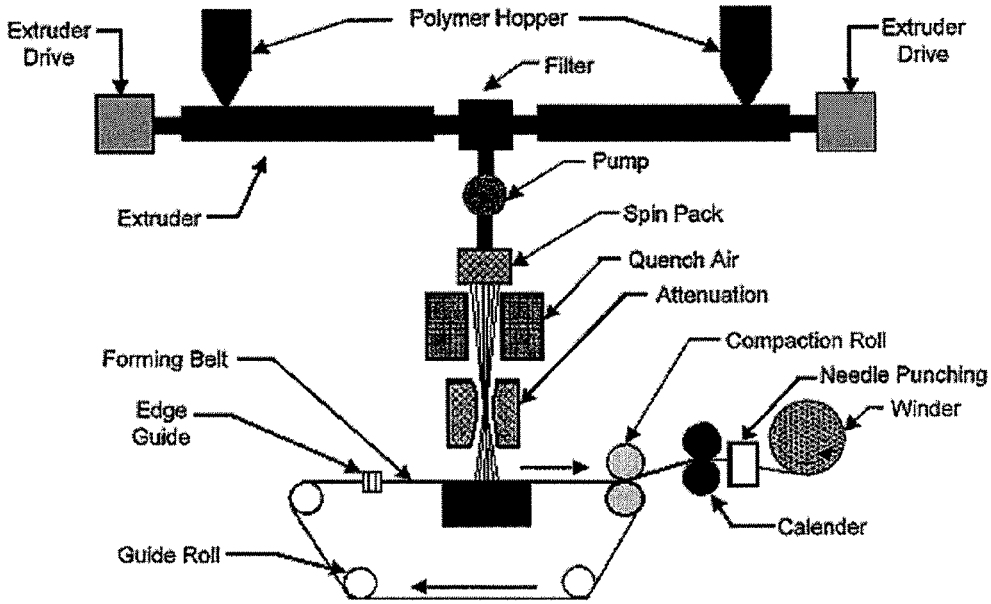
FIG. 5 depicts a typical bicomponent spunbonding process.
Figure 6:
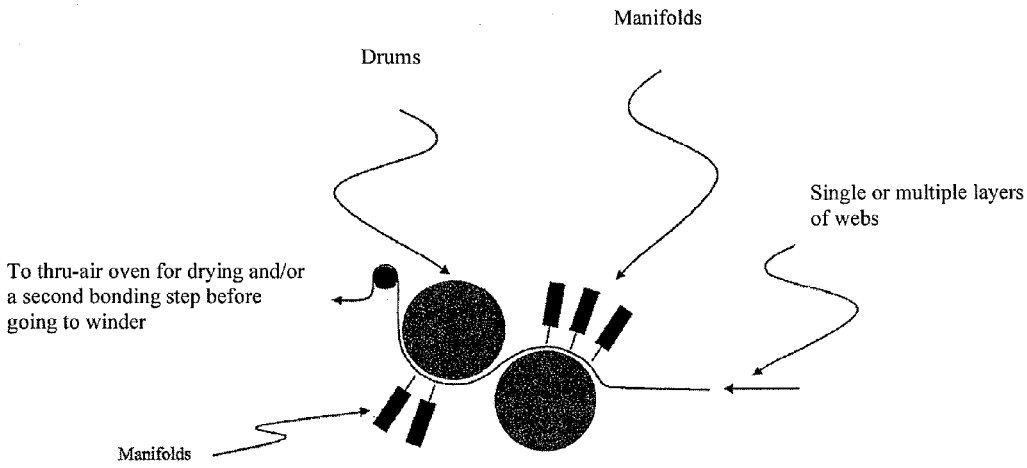
FIG. 6 shows the typical process for hydroentangling using a drum entangler

A schematic of a typical configuration for a bicomponent fiber spunbonding process is depicted in FIG. 5. As shown, at least two different polymer hoppers provide a melt-extrudable polymer that is filtered and pumped through a spin pack that combines the polymers in the desired cross-sectional multicomponent configuration. The molten fibers are then quenched with air, attenuated or drawn down, and deposited on a moving belt to form a fiber web. As shown, the process can optionally include thermal bonding the fiber web using heated calendaring rolls and/or a needle punching station. The fiber web can then be collected as shown in FIG. 5, although it is also possible to pass the fiber web through a hydroentangling process as shown in FIG. 6 prior to collection of the fiber web. As shown in FIG. 6, a typical hydroentangling process can include subjecting both sides of a fiber web to water pressure from multiple hydroentangling manifolds, although the process can also include impingement of water on only one side. The invention is not limited to spunbonding processes to produce a nonwoven fabric and also includes, for example, nonwoven fabrics formed using staple fibers formed into a web. One exemplary spunbonding technique that can be used to make certain embodiments of the invention is set forth in U.S. Pat. No. 6,964,931, which is incorporated by reference herein.

In one preferred embodiment, the mixed fibers will be spun and extruded simultaneously using the same spin beam. Alternatively, the fibers may be extruded simultaneously using different spin beams. In another embodiment, discontinuous fibers of multicomponent filaments and monocomponent or other multicomponent filaments may be intimately mixed and formed into a web in a staple fiber process such as airlay, wetlay, carding, or a combination thereof. Alternatively, discontinuous fiber webs of various multicomponent filaments or multicomponent filaments and homofilaments may be layered to give a mixed fiber web via a staple fiber process such as airlay, wetlay, carding, or a combination thereof.

The fibers of the invention can be used to form filament yarns and staple yarns. In these embodiments, splitting or fibrillation of the fibers, where desired, can be accomplished by texturing, drawing, twisting, or washing the fiber with a solvent. Alternatively, fabrics can be made using the fibers of the invention, including woven, knitted, braided, and nonwoven fabrics.

Where one or more of the fibers comprising the nonwoven material has an islands in the sea configuration, the polymer comprising the sea portion of the fibers can be removed by chemical treatment after the fabric is bonded. The island fibers remain, and the resulting material is somewhat porous, and provides a network of fibers that can be utilized in applications requiring less dense fabrics.

Where one or more of the fibers comprising the nonwoven material has a segmented configuration, the component segments may be broken up mechanically and bonded in a single step by hydroentangling. The typical process for hydroentangling using a drum entangler is illustrated in FIG. 6. The resulting monocomponent fibers can serve to reinforce the structure, leading to a higher-strength material. The structure can also be thermally bonded so that one component can be subsequently removed to yield a more porous network, for example, for use in filtration applications.

Fibrillation of a splittable fiber involves imparting mechanical energy to the multicomponent fibers of the invention using various means. For example, the fibrillation may be conducted mechanically, via heat, or via hydroentangling.

The amount of mechanical energy necessary to fibrillate the fiber will depend on a number of factors, including the desired level of fibrillation (i.e., the percentage of fibers to be split), the polymers used in the various components of the fiber, the volume percentage of the various components of the multicomponent fiber, and the fibrillating technique utilized. Where hydroentangling is used as the fibrillating energy source, the amount of energy typically necessary is between about 2000 Kj/Kg to about 6000 Kj/Kg. In one embodiment, the hydroentangling method involves exposing a web of the multicomponent fibers of the invention to water pressure from one or more hydroentangling manifolds at a water pressure in the range of 10 bar to 1000 bar.

Exemplary fibrillation techniques include:

(a) needle punching followed by hydroentangling without any thermal bonding wherein both the needle punching and the hydroentangling energy result in partial or complete splitting of the multicomponent fibers;

(b) hydroentangling the web alone without any needle punching or subsequent thermal bonding wherein the hydroentangling energy result in partial or complete splitting of the multicomponent fibers;

(c) hydroentangling the web as described in (a) above followed by thermal bonding in a calendar; or (d) hydroentangling the web as described in (a) above followed by thermal bonding in a thru-air oven at a temperature at or above the melting temperature of the outer (i.e., exposed) fiber component to form a stronger fabric.

When hydroentangling is used in forming a nonwoven fabric according to the invention, sufficient entangling and/or mechanical separation of the bicomponent fibers may be achieved through use of a single pass through the hydroentangling apparatus, as described herein. In other embodiments, it may be useful to repeat the hydroentangling process. For example, in some embodiments, the method of the invention may comprise 2 passes, three passes, 4 passes, 5 passes, or even more passes through a hydroentangling apparatus. In other words, the same piece of nonwoven fabric may be subjected to a plurality of hydroentangling procedures or steps.

When thermal bonding (such as calendaring) is used in the invention, such thermal bonding can be carried out at a variety of temperatures. In some embodiments, thermal bonding is carried out at a temperature of about 80° C. to about 200° C., about 90° C. to about 180° C., about 100° C. to about 170° C., about 110° C. to about 170° C., or about 120° C. to about 170° C.

The present invention can be characterized particularly by the ability to reduce packing tightness of the fibers in the filament web during the bonding process due to the presence of fibers of different diameters. Therefore, the resulting nonwoven fabric can have a significantly reduced density since the higher denier fibers contained therein can function to lessen compaction in relation to a typical homogenous nonwoven material. These larger diameter fibers can be present within the nonwoven material as a result of either the provision of multicomponent filaments with relatively large diameter islands/segments contained therein, or the provision of relatively large diameter monocomponent filaments as described above. The higher denier fibers with larger diameters provide compressive resilience while the smaller micro- or nano-denier fibers from the other multicomponent filaments provide thermal insulation or filtration capabilities to the nonwoven fabric. The resulting material can also maintain its low tear properties. This combination of properties is particularly advantageous, for example, in such applications as aerosol filtration media and specialty insulation media as well as in wipes, clothing, and artificial leather.

In particular embodiments, the multicomponent and monocomponent fibers may have different cross-sectional shapes (e.g., round, oval, multilobal, etc.). These various cross-sectional shapes may provide for more bulk in the fabric and may enable the fibers contained within the nonwoven fabric to have more movement than when flat or wedge-shaped fibers are contained therein. Additionally, fibers with such cross-sectional shapes can result in nonwoven fabrics having increased tear resistance and having improved transport properties.

In selecting the materials for the fiber components, various types of polymers may be utilized as long as, with regard to fibers having an islands in the sea configuration or any fiber structure intended to be splittable, the various fiber components are incompatible. Incompatibility is defined herein as the two fiber components forming clear interfaces between the two such that one does not diffuse into the other. One of the better examples includes the utilization of nylon and polyester for the two various components, but the invention is not limited to any particular types of polymers.

In one embodiment, any multicomponent or monocomponent fiber utilized in the invention comprises one or more thermoplastic polymers selected from: polyesters, polyamides, copolyetherester elastomers, polyolefins, polyurethanes, polyacrylates, cellulose esters, liquid crystalline polymers, and mixtures thereof. A preferred copolyetherester elastomer has long chain ether ester units and short chain ester units joined head to tail through ester linkages. In one preferred embodiment, at least one component of the multicomponent fibers of the invention comprise a polymer selected from the group consisting of nylon 6, nylon 6/6, nylon 6, 6/6, nylon 6/10, nylon 6/11, nylon 6/12, and mixtures thereof. In yet another embodiment, the multicomponent fibers of the invention comprise a polyamide or polyester polymer as one component (e.g., the islands of the islands in the sea fiber configuration) and a polyolefin, polyamide, polyester, or copolyester as the second component (e.g., the sea component of the islands in the sea fiber), wherein the two components are different. The outer component in a sheath/core or islands in the sea fiber configuration preferably has a lower viscosity than the inner component of the fiber (e.g., the core or islands component).

In certain embodiments, it may be desirable for one component of the multicomponent fibers of the invention to be soluble in a particular solvent so that the fiber component can be removed from the fiber (or a fabric comprising the fiber) during processing. Any solvent extraction technique known in the art can be used to remove the soluble polymer component at any point following fiber formation. For example, the soluble fiber component could be formed from a polymer that is soluble in an aqueous caustic solution such as polyglycolic acid (PGA), polylactic acid (PLA), polycaprolactone (PCL), and copolymers or blends thereof. In another embodiment, the soluble fiber component could be formed form a polymer that is soluble in water such as sulfonated polyesters, polyvinyl alcohol, sulfonated polystyrene, and copolymers or polymer blends containing such polymers.

Nonwoven fabrics according to the present invention can be characterized, in some embodiments, in terms of the ratios of the polymers used in preparing the fabrics. For example, a fabric could be formed using a bicomponent fiber formed of polymer A and polymer B and using a homopolymer fiber formed of polymer A or polymer B.

In other embodiments, the fabric could be formed using a first bicomponent fiber formed of polymer A and polymer B and a second bicomponent fiber formed of polymer A and polymer B but having dimensions that differ from the dimension of the first bicomponent fiber.

When only two polymers are used in preparing a mixed fiber nonwoven fabric according to the invention, the ratio of polymer A to polymer B can be about 50/50 to about 5/95, based on the overall weight of the polymers. In further embodiments, the polymer ratio can be about 50/50 to about 10/90, about 50/50 to about 15/85, about 50/50 to about 20/80, or about 50/50 to about 25/75. In specific embodiments, the polymer ratio for the overall nonwoven fabric can be about 50/50, about 55/45, about 60/40, about 65/35, about 70/30, about 75/25, about 80/20, about 85/15, or about 90/10.

The polymeric components of the fibers of the invention can optionally include other components or materials not adversely affecting the desired properties thereof. Exemplary materials that can be present include, without limitation, antioxidants, stabilizers, surfactants, waxes, flow promoters, solid solvents, particulates, and other materials added to enhance processability or end-use properties of the polymeric components. Such additives can be used in conventional amounts.

The invention relates to a method for producing a spunbonded or meltblown nonwoven fabric having improved flexibility, breathability, compression resilience, strength, and filtration and thermal properties, which has been disclosed. The basis for the invention is the combination of fibers of varying diameter (multicomponent fibers that will produce micro- or nano-denier fibers after splitting/processing, in combination with either other higher denier multicomponent fibers or monocomponent macro-denier fibers) to generate a fabric in which the overall structure does not compact as significantly during bonding as occurs in monocomponent or multicomponent homogeneous materials.

The invention is particularly beneficial in light of the ability to produce nonwoven fabrics having improved properties. For example, the fabrics can exhibit beneficial air permeability and filtration. The fabrics according to the invention also can exhibit one or more of increased grab tensile strength, tongue tear strength, or trapezoidal tear strength.

Aerosol filtration can generally relate to the ability to trap aerosolized particles. The mechanism of action in aerosol filtration does not relate to simple sieving but rather to particle deposition. Thus, high collection efficiency of porous membrane filters extends to aerosol particle diameters much smaller than simply the filter's pore size. Aerosol filtration performance of a material (e.g., a nonwoven fabric) can be determined through evaluating characteristics, such as particle penetration, particle capture efficiency, and air flow resistance. One apparatus that may be used to perform such testing is a TSI automated filter tester (TSI Incorporated, Shoreview, Minn.).

The evaluated characteristics can be used to determine the quality factor (QF) of the filter material. Filter quality factor is a parameter used for filter evaluation which combines the collection efficiency and the pressure drop and is calculated according to the following equation:

$$QF\ (mmH_2O^{-1}) = \frac{-\ln P}{\Delta P}$$

wherein, P is the penetration of the challenging aerosol and ΔP is the resistance to flow through the test material.

As seen above, QF is reported in units of $mmH_2O^{-1}$, and QF can vary based on the face velocity of the challenging aerosol through the test fabric. In some embodiments, a nonwoven fabric prepared according to the invention using mixed fibers can have a QF, when measured at a face velocity of 3.3 cm/s, of greater than about 0.10, at least about 0.12, at least about 0.14, at least about 0.15, at least about 0.16, at least about 0.18, at least about 0.21, at least about 0.22, between about 0.11 and about 0.25, between about 0.12 and about 0.22, or between about 0.15 and about 0.25. In other embodiments, a nonwoven fabric prepared according to the invention using mixed fibers can have a QF, when measured at a face velocity of 5.3 cm/s, of greater than about 0.05, at least about 0.06, at least about 0.07, at least about 0.08, at least about 0.09, at least about 0.10, at least about 0.11, between about 0.06 and about 0.12, between about 0.08 and about 0.12, or between about 0.10 and about 0.15.

Liquid filtration relates to the ability to retain particulate matter in a liquid stream and prevent the particulate flow through the filter material while still allowing flow through by the liquid. Liquid filtration performance can be tested by a variety of methods. One method comprises simply adding a test particulate material to deionized water at a known concentration, passing the liquid with the test particulate material through the test filter material at a known face velocity, and measuring the concentration of the test particulate material after passing through the filter. Particulate concentration can be measured using a turbidimeter, such as available from Hach Company, Loveland, Colo. One example of a particulate material that could be used is SIL-CO-SIL® 106 (available from U.S. Silica Co., Mill Creek, Okla.), which is a mixture of silica particles having a known sieve size distribution.

Filtration efficiency can be defined as the percentage ratio of the particle concentration upstream compared to the downstream concentration when passed through a filter body. Filtration efficiency can be calculated according to the following equation:

$$\text{Efficiency}(\%) = \frac{C_0 - C}{C_0} \times 100$$

wherein, $C_0$ is the initial concentration of the particulate material in the DI water, and C is the concentration of the particulate material in the DI water after operating for 1 min (i.e., after 1 minute of flowing the liquid through the filter material).

Filter resistance can also be measured as the resistance to flow (e.g., in pounds per square inch) through the filter material at a defined face velocity. While good filter efficiency is desired, high efficiency can be negated by corresponding high resistance. In other words, effective liquid filtration depends upon the ability to effectively trap particulate matter while still allowing the liquid stream to pass with relative ease. Thus, low resistance is highly desired.

In some embodiments, a nonwoven fabric according to the invention can exhibit a liquid filtration efficiency, as described above, of at least about 65% while exhibiting a flow resistance of less than about 0.03 psi, less than about 0.02 psi, or less than about 0.01 psi at a face velocity of 0.04 cm/s. In other embodiments, a nonwoven fabric according to the invention can exhibit a liquid filtration efficiency of at least about 65% while exhibiting a flow resistance of less than about 0.11 psi, less than about 0.10 psi, less than about 0.09 psi, less than about 0.08, less than about 0.06, or less than about 0.05 at a face velocity of 0.13 cm/s. In further embodiments, a nonwoven fabric according to the invention can exhibit a liquid filtration efficiency of at least about 65% while exhibiting a flow resistance of less than about 0.18 psi, less than about 0.16 psi, less than about 0.14 psi, less than about 0.12, less than about 0.10, or less than about 0.08 at a face velocity of 0.22 cm/s. In still further embodiments, the above flow resistance values may be exhibited while likewise exhibiting a liquid filtration efficiency of at least about 70%. In other words, at least about 65% or at least about 70% of the particulate matter in the liquid sample is retained by the filter.

Air permeability is an important factor in the performance of textiles, particularly in filter materials. Air permeability can specifically be tested according to ASTM D 737-04 (year 2004 edition), with greater air permeability typically being preferred.

In certain embodiments, nonwoven fabrics prepared according to the invention exhibit an air permeability of at least about 10 $ft^3/ft^2$ min. In other embodiments, the nonwoven fabrics exhibit an air permeability of at least about 12 $ft^3/ft^2$ min, at least about 15 $ft^3/ft^2$ min, at least about 18 $ft^3/ft^2$ min, at least about 20 $ft^3/ft^2$ min, at least about 30 $ft^3/ft^2$ min, at least about 40 $ft^3/ft^2$ min, at least about 50 $ft^3/ft^2$ min, at least about 60 $ft^3/ft^2$ min, at least about 70 $ft^3/ft^2$ min, at least about 80 $ft^3/ft^2$ min, or at least about 90 $ft^3/ft^2$ min. In still further embodiments, nonwoven fabrics can exhibit an air permeability of about 10 $ft^3/ft^2$ min to about 100 $ft^3/ft^2$ min, 15 $ft^3/ft^2$ min to about 90 $ft^3/ft^2$ min, 10 $ft^3/ft^2$ min to about 80 $ft^3/ft^2$ min, 10 $ft^3/ft^2$ min to about 70 $ft^3/ft^2$ min, about 10 $ft^3/ft^2$ min to about 60 $ft^3/ft^2$ min, about 10 $ft^3/ft^2$ min to about 50 $ft^3/ft^2$ min, about 15 $ft^3/ft^2$ min to about 50 $ft^3/ft^2$ min, or about 20 $ft^3/ft^2$ min to about 50 $ft^3/ft^2$ min.

Grab tensile strength is a measure of the breaking strength of the fabric and can be measured by the method provided in ASTM D5034 (year 2008 edition). According to ASTM D5034, the fabric sample is placed into a tensile testing machine that grips the fabric with two clamps, and one clamp slowly moves away from the other clamp, which remains stationary. The grab tensile strength is the highest tensile load achieved just before the fabric tears or breaks. Grab tensile strength can be measured in the machine direction and the cross machine direction of the fabric.

In certain embodiments, nonwoven fabrics prepared according to the invention exhibit a grab tensile strength in the machine direction (MD) of at least about 20 kilogram-force (kgf), at least about 25 kgf, at least about 30 kgf, at least about 35 kgf, at least about 40 kgf, at least about 45 kgf, at least about 50 kgf, at least about 55 kgf, or at least about 60 kgf. Particularly, MD grab tensile strength can be about 10 kgf to about 70 kgf, about 20 kgf to about 70 kgf, about 20 kgf to about 60 kgf, or about 30 kgf to about 60 kgf. In particular embodiments, the foregoing MD grab tensile strength can be for a nonwoven fabric according to the invention having a basis weight of 100 gsm. In other embodiments, the foregoing MD grab tensile strength can be proportionally higher for a nonwoven fabric according to the invention having a greater basis weight (e.g., 150 gsm).

In further embodiments, nonwoven fabrics prepared according to the invention exhibit a grab tensile strength in the cross-machine direction (CD) of at least about 10 kgf, at least about 15 kgf, at least about 20 kgf, at least about 25 kgf, at least about 30 kgf, at least about 35 kgf, or at least about 40 kgf. Particularly, CD grab tensile strength can be about 10 kgf to about 50 kgf, about 10 kgf to about 40 kgf, about 20 kgf to about 50 kgf, or about 20 kgf to about 40 kgf. In particular embodiments, the foregoing CD grab tensile strength can be for a nonwoven fabric according to the invention having a basis weight of 100 gsm. In other embodiments, the foregoing CD grab tensile strength can be proportionally higher for a nonwoven fabric according to the invention having a greater basis weight (e.g., 150 gsm).

Tongue tear strength is a measure of the force required to continue a rip through the fabric and can be measured by the method provided in ASTM D2261 (year 2007 edition). According to ASTM D2261, a rectangular piece of fabric of specific dimensions is slit in the center approximately halfway down the short direction of the fabric. The two ends of the slit piece are subjected to a tensile strength test. The tongue tear strength is the highest tensile load achieved just before the fabric begins to tear or break. Tongue tear strength can be measured in the machine direction and the cross machine direction of the fabric.

In certain embodiments, nonwoven fabrics prepared according to the invention exhibit a tongue tear strength in the machine direction (MD) of at least about 1 kgf, at least about 2 kgf, at least about 3 kgf, at least about 4 kgf, at least about 5 kgf, at least about 6 kgf, at least about 7 kgf, at least about 8 kgf, at least about 9 kgf, or at least about 10 kgf. Particularly, MD tongue tear strength can be about 1 kgf to about 12 kgf, about 2 kgf to about 12 kgf, about 3 kgf to about 12 kgf, about 4 kgf to about 5 kgf, or about 5 kgf to about 10 kgf. In particular embodiments, the foregoing MD tongue tear strength can be for a nonwoven fabric according to the invention having a basis weight of 100 gsm. In other embodiments, the foregoing MD tongue tear strength can be proportionally higher for a nonwoven fabric according to the invention having a greater basis weight (e.g., 150 gsm).

In further embodiments, nonwoven fabrics prepared according to the invention exhibit a tongue tear strength in the cross-machine direction (CD) of at least about 1 kgf, at least about 2 kgf, at least about 3 kgf, at least about 4 kgf, at least about 5 kgf, at least about 6 kgf, at least about 7 kgf, at least about 8 kgf, at least about 9 kgf, or at least about 10 kgf. Particularly, CD tongue tear strength can be about 1 kgf to about 12 kgf, about 2 kgf to about 12 kgf, about 3 kgf to about 12 kgf, about 4 kgf to about 5 kgf, or about 5 kgf to about 10 kgf. In particular embodiments, the foregoing CD tongue tear strength can be for a nonwoven fabric according to the invention having a basis weight of 100 gsm. In other embodiments, the foregoing CD tongue tear strength can be proportionally higher for a nonwoven fabric according to the invention having a greater basis weight (e.g., 150 gsm).

Trapezoidal tear strength is a measure of the tearing strength of nonwoven fabrics by the trapezoid procedure using a recording constant-rate-of-extension (CRE) tensile testing machine and can be measured by the method provided in ASTM D5733 (year 1999 edition). Trapezoid tear strength as measured in this test method is the maximum tearing force required to continue or propagate a tear started previously in the specimen. The reported value is not directly related to the force required to initiate or start a tear. Trapezoidal tear strength can be measured in the machine direction and the cross machine direction of the fabric.

In certain embodiments, nonwoven fabrics prepared according to the invention exhibit a trapezoidal tear strength in the machine direction (MD) of at least about 1 kgf, at least about 2 kgf, at least about 3 kgf, at least about 4 kgf, at least about 5 kgf, at least about 6 kgf, at least about 7 kgf, at least about 8 kgf, at least about 9 kgf, at least about 10 kgf, at least about 15 kgf, at least about 20 kgf, at least about 25 kgf, or at least about 30 kgf. Particularly, MD trapezoidal tear strength can be about 1 kgf to about 30 kgf, about 5 kgf to about 30 kgf, about 10 kgf to about 30 kgf, about 1 kgf to about 20 kgf, about 5 kgf to about 20 kgf, about 1 kgf to about 12 kgf, or about 1 kgf to about 10 kgf. In particular embodiments, the foregoing MD trapezoidal tear strength can be for a nonwoven fabric according to the invention having a basis weight of 100 gsm. In other embodiments, the foregoing MD trapezoidal tear strength can be proportionally higher for a nonwoven fabric according to the invention having a greater basis weight (e.g., 150 gsm).

In further embodiments, nonwoven fabrics prepared according to the invention exhibit a trapezoidal tear strength in the cross-machine direction (CD) of at least about 1 kgf, at least about 2 kgf, at least about 3 kgf, at least about 4 kgf, at least about 5 kgf, at least about 6 kgf, at least about 7 kgf, at least about 8 kgf, at least about 9 kgf, at least about 10 kgf, at least about 15 kgf, at least about 20 kgf, at least about 25 kgf, or at least about 30 kgf. Particularly, MD trapezoidal tear strength can be about 1 kgf to about 30 kgf, about 5 kgf to about 30 kgf, about 10 kgf to about 30 kgf, about 1 kgf to about 20 kgf, about 5 kgf to about 20 kgf, about 1 kgf to about 12 kgf, or about 1 kgf to about 10 kgf. In particular embodiments, the foregoing CD trapezoidal tear strength can be for a nonwoven fabric according to the invention having a basis weight of 100 gsm. In other embodiments, the foregoing CD trapezoidal tear strength can be proportionally higher for a nonwoven fabric according to the invention having a greater basis weight (e.g., 150 gsm).

In certain embodiments of the invention, the basis weight, or the weight per unit surface area, of a nonwoven fabric according to the invention may affect certain properties of the fabric. In specific embodiments, the basis weight of the fabric can be at least about 50 grams per square meter (gsm), at least about 60 gsm, at least about 70 gsm, at least about 80 gsm, at least about 90 gsm, at least about 100 gsm, at least about 110 gsm, at least about 120 gsm, at least about 130 gsm, at least about 140 gsm, at least about 150 gsm, at least about 160 gsm, at least about 170 gsm, at least about 180 gsm, or at least about 200 gsm. Without intending to be limiting, generally, when all other factors are constant, increasing the basis weight of the nonwoven fabric will cause the strength or, more specifically, a property measurement related to the strength of the nonwoven fabric to become increased.

EXPERIMENTATION

The present invention is more fully illustrated by the following examples, which are set forth to illustrate certain embodiments the present invention and are not to be construed as limiting.

Example 1

Figure 7:
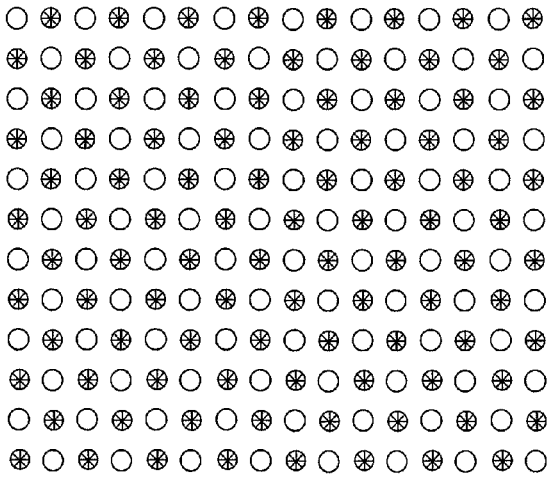
FIG. 7 is a schematic representation of the sectional arrangement in a spinneret for a mixed-alternate spunbond spin-pack.
Figure 8:
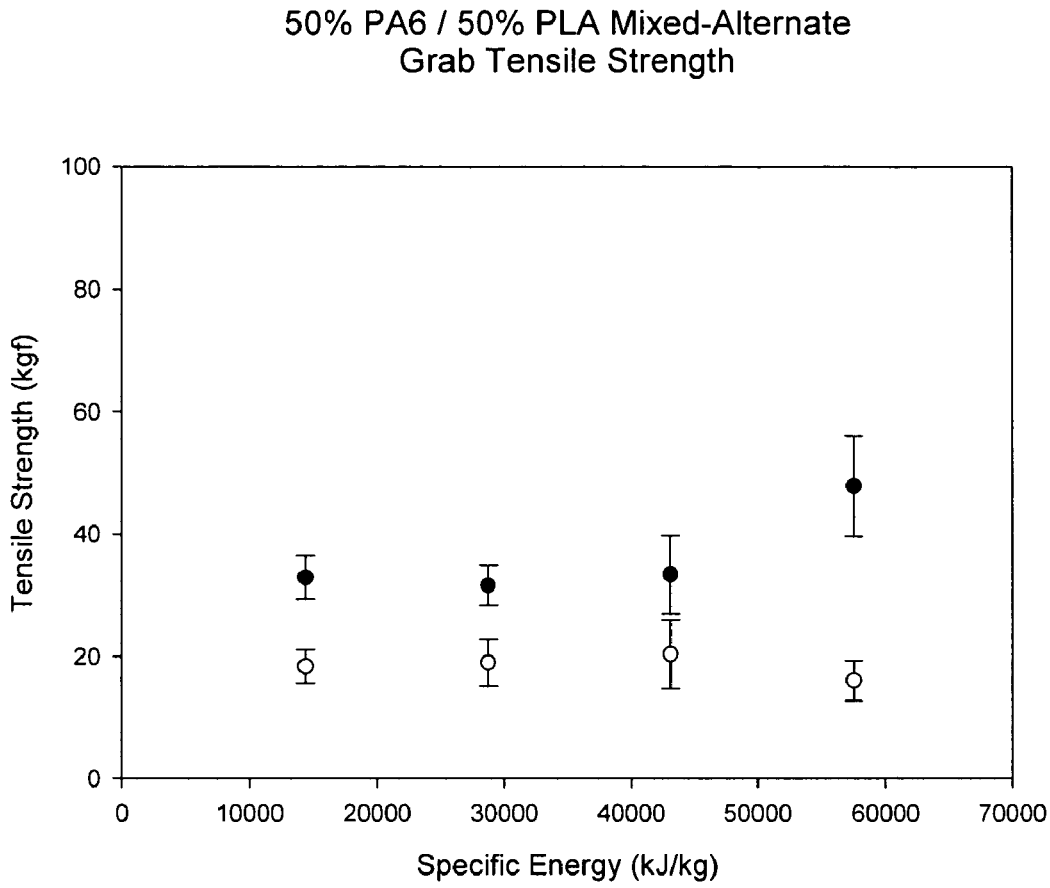
FIG. 8 is a graphical illustration of the grab tensile strength versus hydroentangling energy of a 50/50 PA6/PLA nonwoven fabric prepared according to one embodiment of the invention using a mixed-alternate spin-pack.
Figure 9:
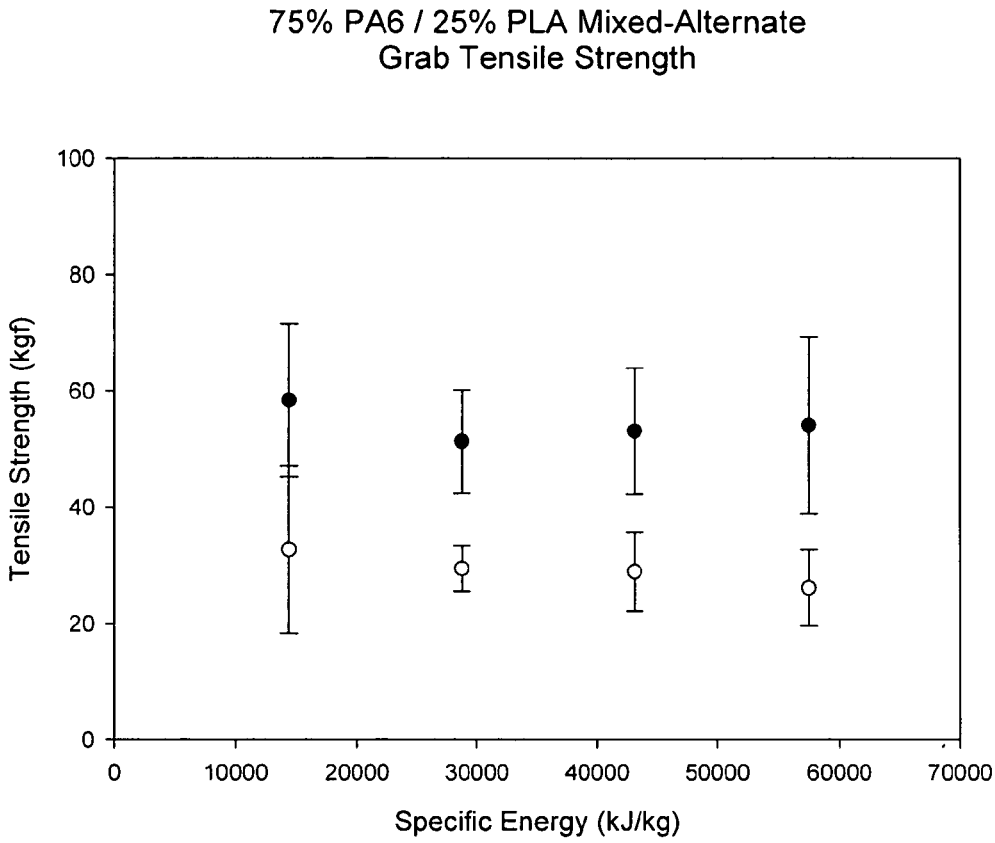
FIG. 9 is a graphical illustration of the grab tensile strength versus hydroentangling energy of a 75/25 PA6/PLA nonwoven fabric prepared according to one embodiment of the invention using a mixed-alternate spin-pack.
Figure 10:
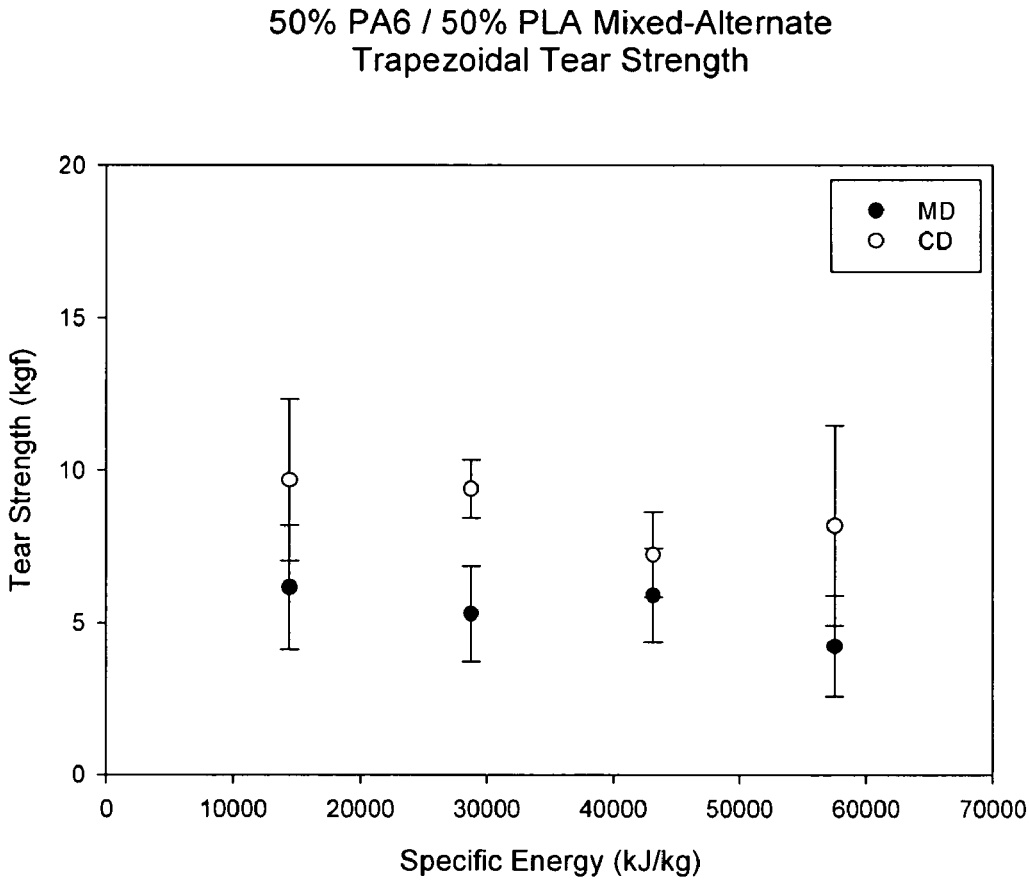
FIG. 10 is a graphical illustration of the trapezoidal tear strength versus hydroentangling energy of a 50/50 PA6/PLA nonwoven fabric prepared according to one embodiment of the invention using a mixed-alternate spin-pack.
Figure 11:
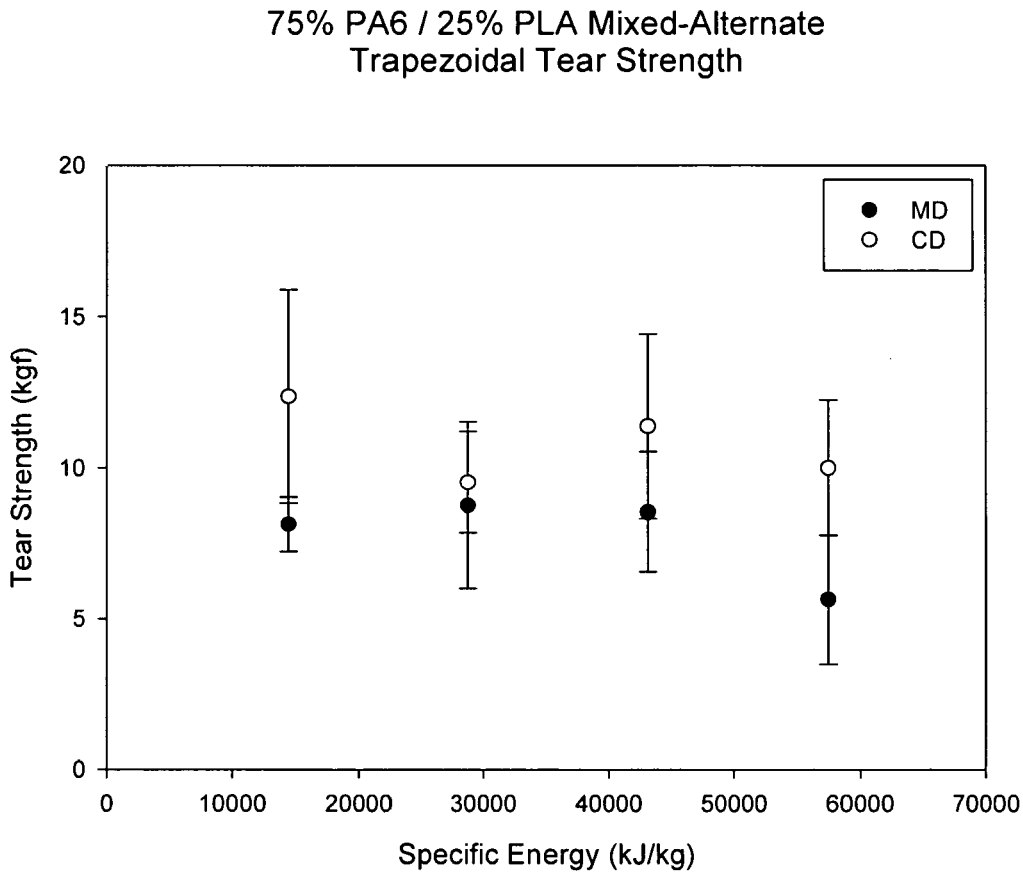
FIG. 11 is a graphical illustration of the trapezoidal tear strength versus hydroentangling energy of a 75/25 PA6/PLA nonwoven fabric prepared according to one embodiment of the invention using a mixed-alternate spin-pack.
Figure 12:
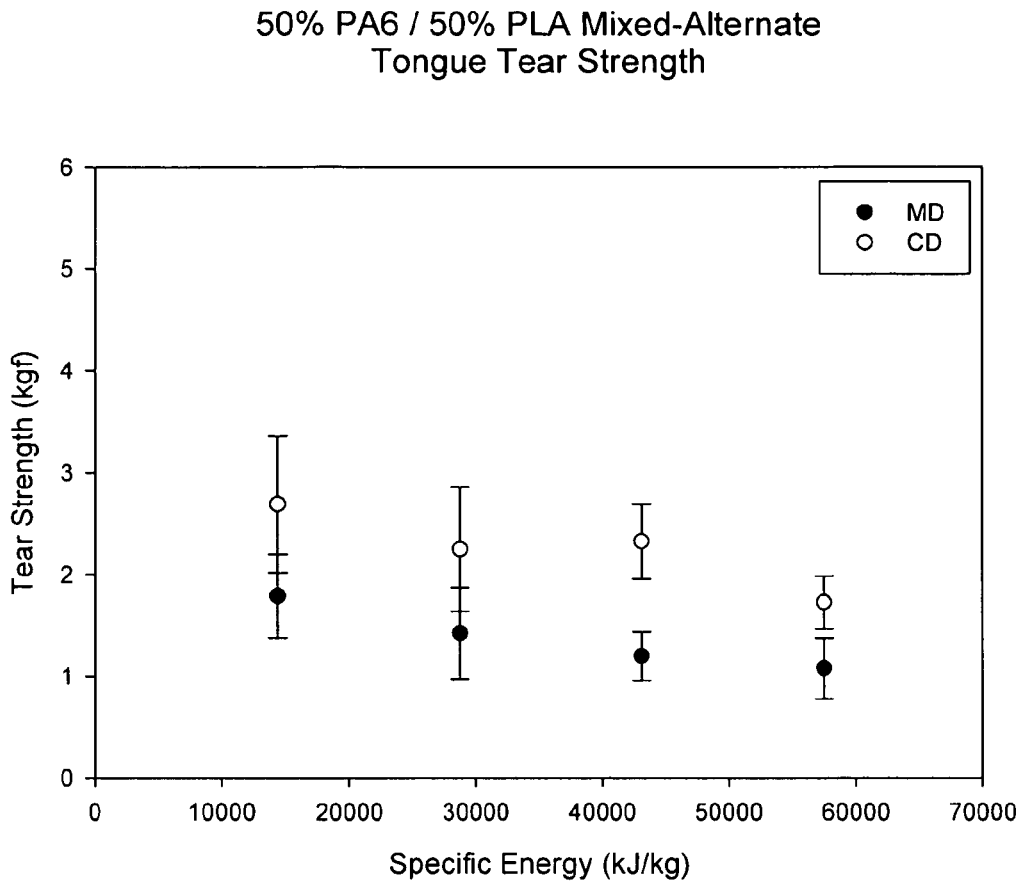
FIG. 12 is a graphical illustration of the tongue tear strength versus hydroentangling energy of a 50/50 PA6/PLA nonwoven fabric prepared according to one embodiment of the invention using a mixed-alternate spin-pack.
Figure 13:
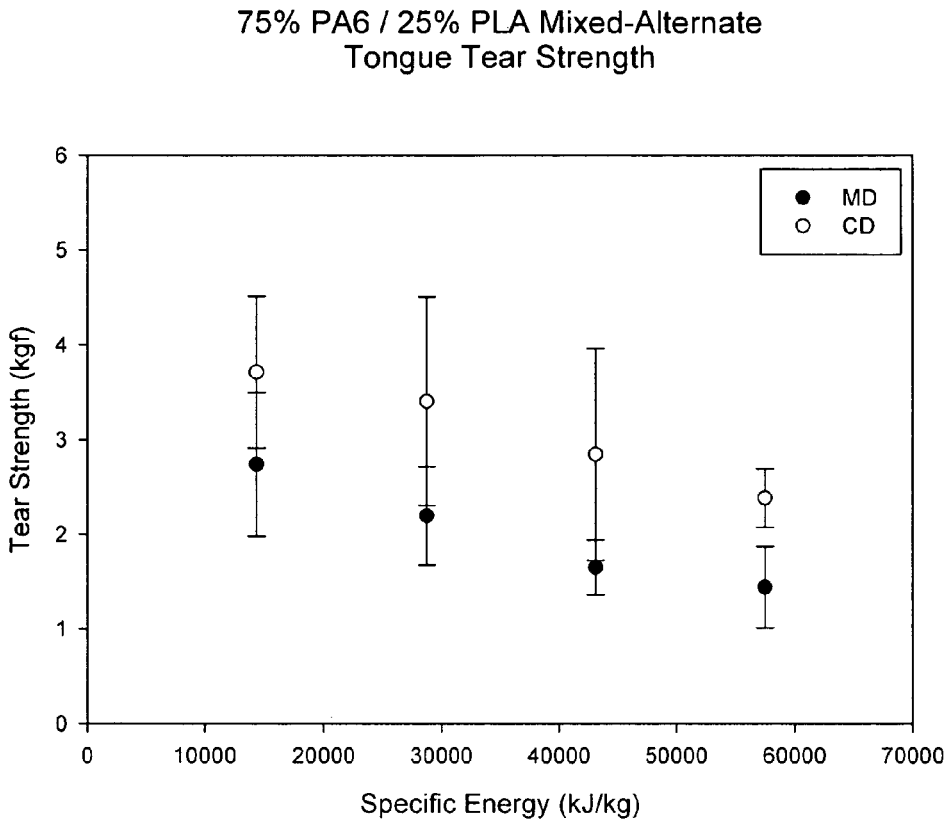
FIG. 13 is a graphical illustration of the tongue tear strength versus hydroentangling energy of a 75/25 PA6/PLA nonwoven fabric prepared according to one embodiment of the invention using a mixed-alternate spin-pack.
Figure 14:
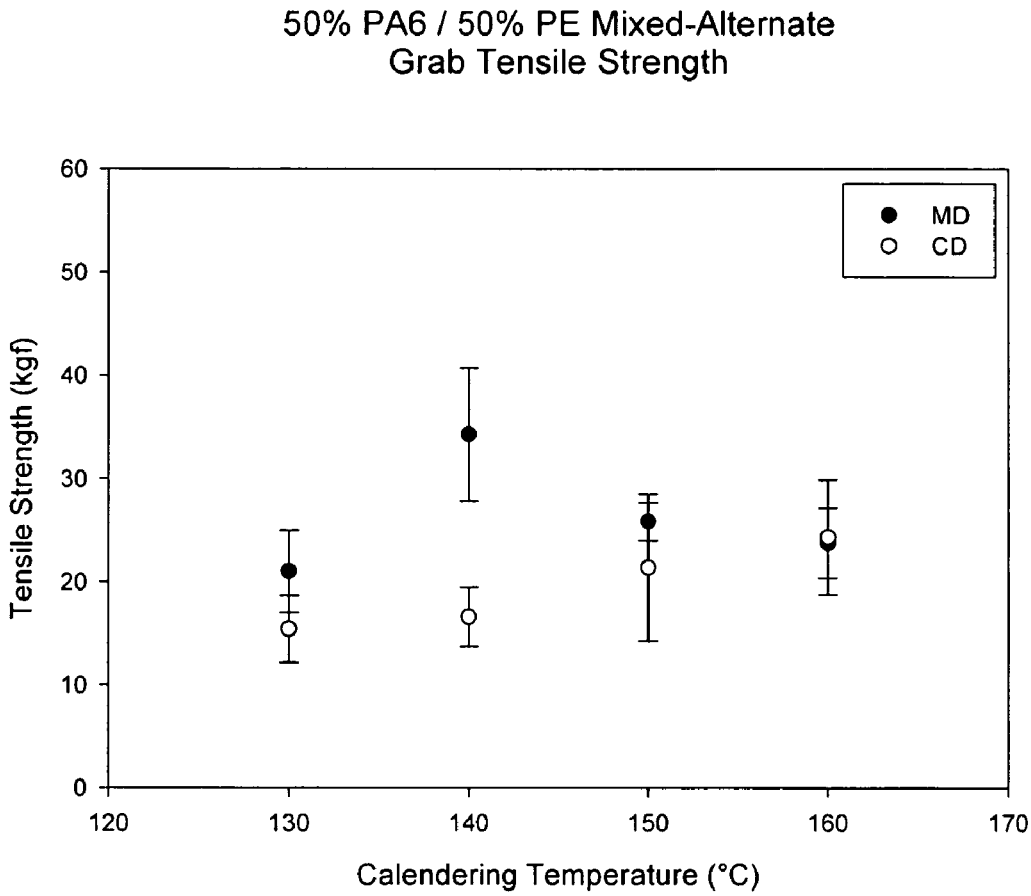
FIG. 14 is a graphical illustration of the grab tensile strength versus calendaring temperature of a 50/50 PA6/PE nonwoven fabric prepared according to one embodiment of the invention using a mixed-alternate spin-pack.
Figure 15:
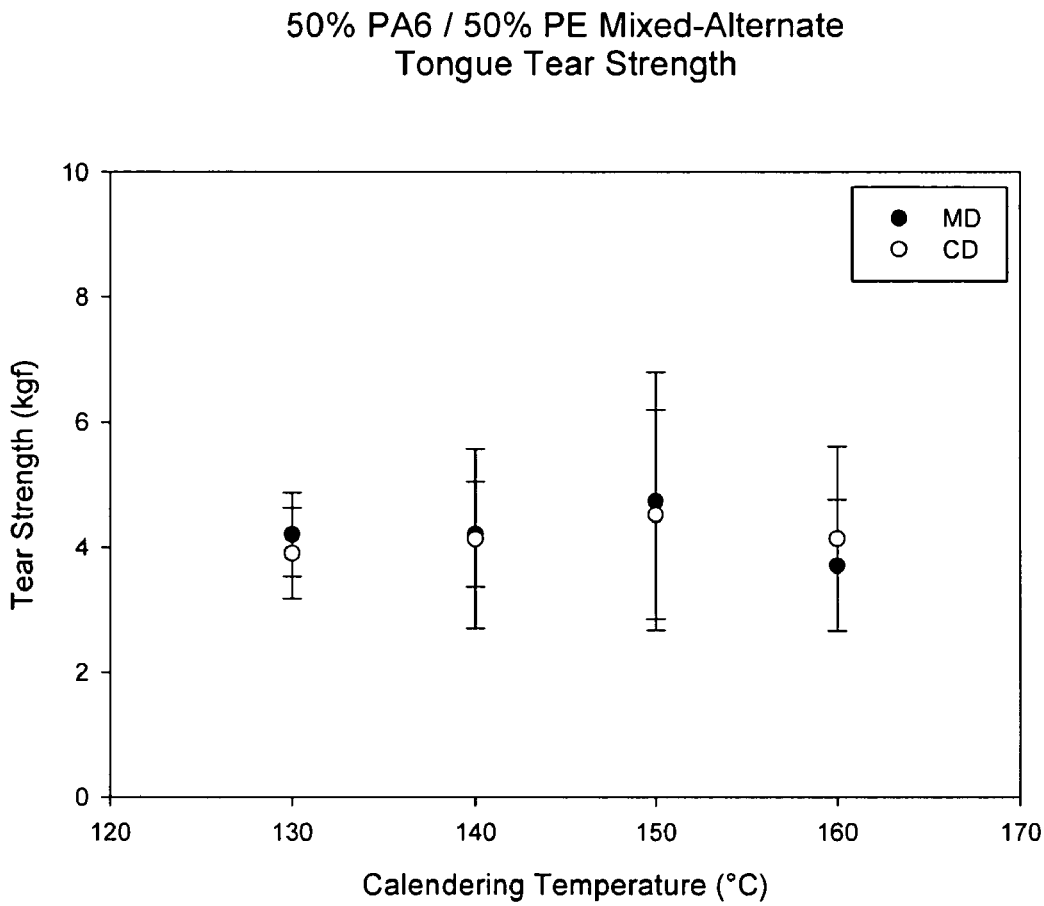
FIG. 15 is a graphical illustration of the tongue tear strength versus calendaring temperature of a 50/50 PA6/PE nonwoven fabric prepared according to one embodiment of the invention using a mixed-alternate spin-pack.
Figure 16:
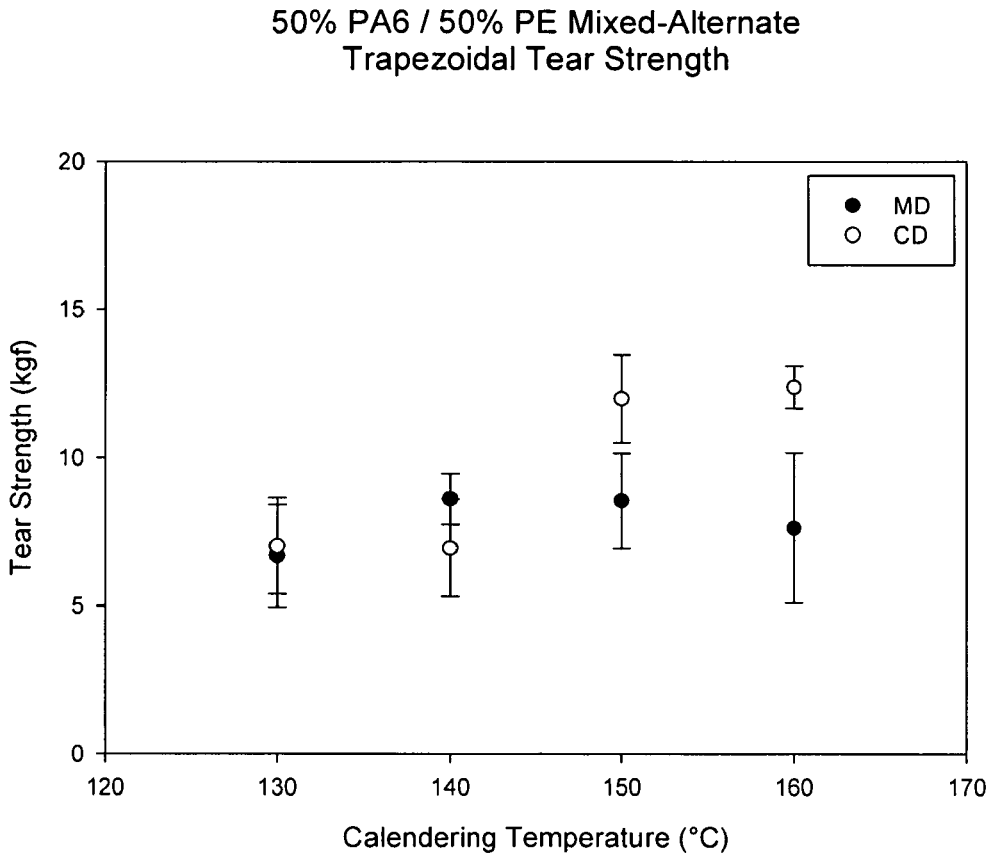
FIG. 16 is a graphical illustration of the trapezoidal tear strength versus calendaring temperature of a 50/50 PA6/PE nonwoven fabric prepared according to one embodiment of the invention using a mixed-alternate spin-pack.

Fabrics Prepared using Segmented Pie Bicomponent Fiber and Monocomponent Fiber with Mixed-Alternate Spin-Pack Design Nonwoven fabrics were prepared using pie/wedge bicomponent fibers having 16 segments per fiber combined with monocomponent fibers. Fabrics that were subjected to hydroentangling were prepared using polyamide 6 (PA6) and polylactic acid (PLA) in defined ratios. Fabrics that were subjected to calendaring were prepared using polyamide 6 (PA6) and polyethylene (PE) in defined ratios. In each case, the monocomponent filaments and the bicomponent filaments were extruded through the same spinneret having the pattern shown in FIG. 7, wherein the open circles represent the orifices for spinning of monocomponent filaments, and the divided circles represent the orifices for spinning of bicomponent filaments. This design is referred to as a mixed-alternate spin-pack design.

Each fabric was formed to have a weight basis of 100 gsm and either hydroentangled or calendared. The fabrics were then tested for grab tensile strength, tongue tear strength, and trapezoidal tear strength using the methods described herein. The specific polymer compositions for each fabric, the treatment, and the tested properties are shown below in Tables 1, 2, and 3. Grab tensile strength, tongue tear strength, and trapezoidal tear strength for the various fabrics are illustrated in FIGS. 8-16.

TABLE 1

| Polymers | Ratio | Monocomponent Fiber | Hydroentangling (passes) | Calendaring Temp. (° C.) | Grab Tensile Strength MD Peak Load (kgf) | Grab Tensile Strength CD Peak Load (kgf) |
|---|---|---|---|---|---|---|
| PA6/PLA | 50/50 | PA6 | 1 | — | 32.9 | 18.4 |
| PA6/PLA | 50/50 | PA6 | 2 | — | 31.6 | 19 |
| PA6/PLA | 50/50 | PA6 | 3 | — | 33.4 | 20.3 |
| PA6/PLA | 50/50 | PA6 | 4 | — | 47.8 | 16.0 |
| PA6/PLA | 75/25 | PA6 | 1 | — | 58.4 | 32.7 |
| PA6/PLA | 75/25 | PA6 | 2 | — | 51.3 | 29.5 |
| PA6/PLA | 75/25 | PA6 | 3 | — | 53.1 | 29 |
| PA6/PLA | 75/25 | PA6 | 4 | — | 54.0 | 26.2 |
| PE/PA6 | 50/50 | PE | — | 130 | 21.0 | 15.4 |
| PE/PA6 | 50/50 | PE | — | 140 | 34.3 | 16.6 |
| PE/PA6 | 50/50 | PE | — | 150 | 25.8 | 21.4 |
| PE/PA6 | 50/50 | PE | — | 160 | 23.7 | 24.3 |

TABLE 2

| Polymers | Ratio | Monocomponent Fiber | Hydroentangling (passes) | Calendaring Temp. (° C.) | Tongue Tear Strength MD Peak Load (kgf) | Tongue Tear Strength CD Peak Load (kgf) |
|---|---|---|---|---|---|---|
| PA6/PLA | 50/50 | PA6 | 1 | — | 1.8 | 2.7 |
| PA6/PLA | 50/50 | PA6 | 2 | — | 1.4 | 2.2 |
| PA6/PLA | 50/50 | PA6 | 3 | — | 1.2 | 2.3 |

TABLE 2-continued

| Polymers | Ratio | Mono-component Fiber | Hydro-entangling (passes) | Calen-daring Temp. (° C.) | Tongue Tear Strength MD Peak Load (kgf) | Tongue Tear Strength CD Peak Load (kgf) |
|---|---|---|---|---|---|---|
| PA6/PLA | 50/50 | PA6 | 4 | — | 1.1 | 1.7 |
| PA6/PLA | 75/25 | PA6 | 1 | — | 2.7 | 3.7 |
| PA6/PLA | 75/25 | PA6 | 2 | — | 2.2 | 3.4 |
| PA6/PLA | 75/25 | PA6 | 3 | — | 1.7 | 2.8 |
| PA6/PLA | 75/25 | PA6 | 4 | — | 1.4 | 2.4 |
| PE/PA6 | 50/50 | PE | — | 130 | 4.2 | 3.9 |
| PE/PA6 | 50/50 | PE | — | 140 | 4.2 | 4.1 |
| PE/PA6 | 50/50 | PE | — | 150 | 4.7 | 4.5 |
| PE/PA6 | 50/50 | PE | — | 160 | 3.7 | 4.1 |

TABLE 3

| Polymers | Ratio | Mono-component Fiber | Hydro-entangling (passes) | Calen-daring Temp. (° C.) | Trapezoidal Tear Strength MD Peak Load (kgf) | Trapezoidal Tear Strength CD Peak Load (kgf) |
|---|---|---|---|---|---|---|
| PA6/PLA | 50/50 | PA6 | 1 | — | 6.1 | 9.7 |
| PA6/PLA | 50/50 | PA6 | 2 | — | 5.3 | 9.4 |
| PA6/PLA | 50/50 | PA6 | 3 | — | 5.9 | 7.2 |
| PA6/PLA | 50/50 | PA6 | 4 | — | 4.2 | 8.2 |
| PA6/PLA | 75/25 | PA6 | 1 | — | 8.1 | 12.4 |
| PA6/PLA | 75/25 | PA6 | 2 | — | 8.7 | 9.5 |
| PA6/PLA | 75/25 | PA6 | 3 | — | 8.5 | 11.4 |
| PA6/PLA | 75/25 | PA6 | 4 | — | 5.6 | 10 |
| PE/PA6 | 50/50 | PE | — | 130 | 6.7 | 7.0 |
| PE/PA6 | 50/50 | PE | — | 140 | 8.6 | 6.9 |
| PE/PA6 | 50/50 | PE | — | 150 | 8.5 | 12 |
| PE/PA6 | 50/50 | PE | — | 160 | 7.6 | 12.4 |

Example 2

Figure 17:
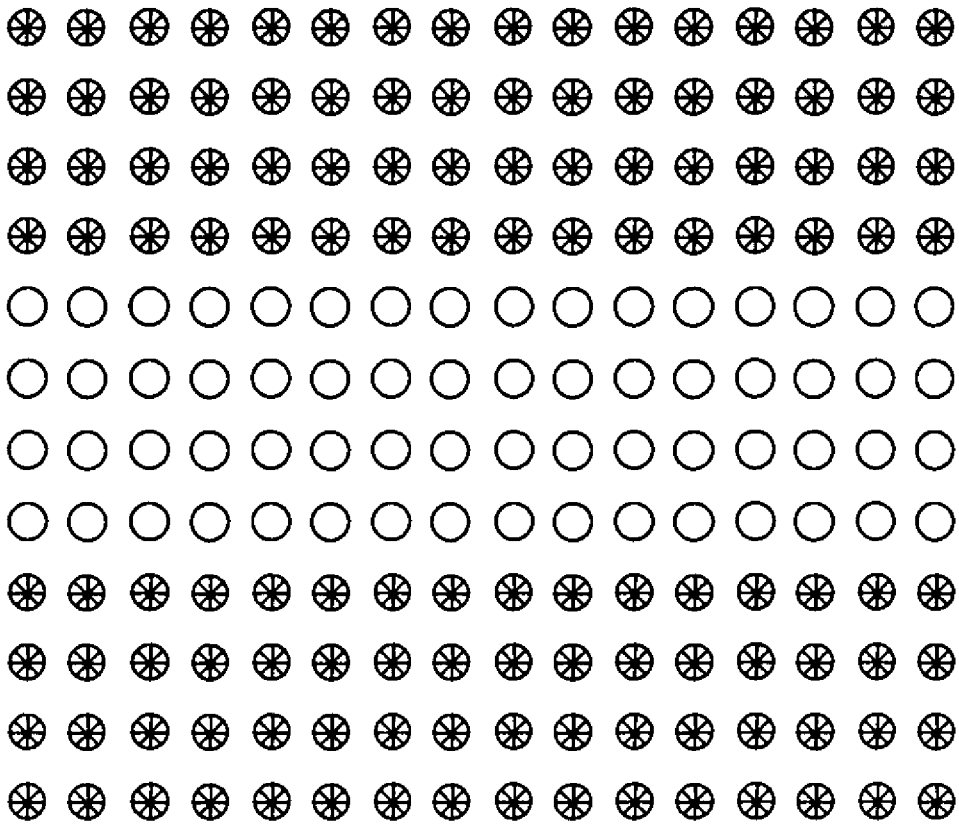
FIG. 17 is a schematic representation of the sectional arrangement in a spinneret for a row-mixed spunbond spin-pack.
Figure 18:
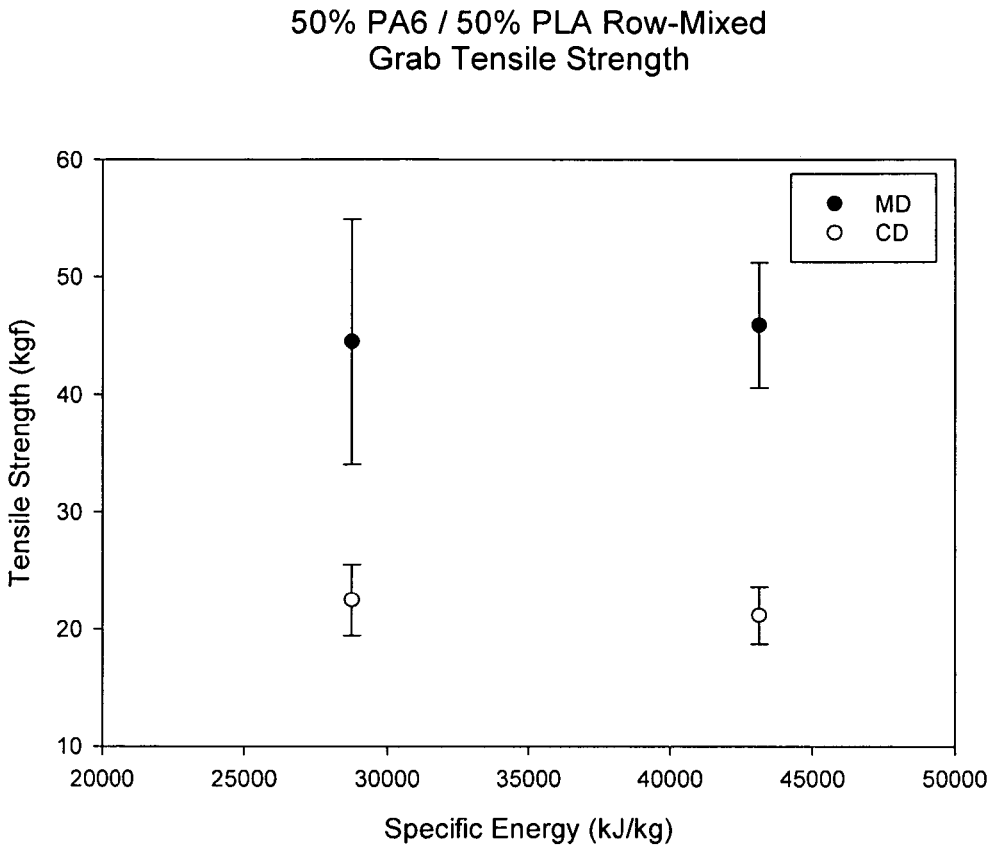
FIG. 18 is a graphical illustration of the grab tensile strength versus hydroentangling energy of a 50/50 PA6/PLA nonwoven fabric prepared according to one embodiment of the invention using a row-mixed spin-pack.
Figure 19:
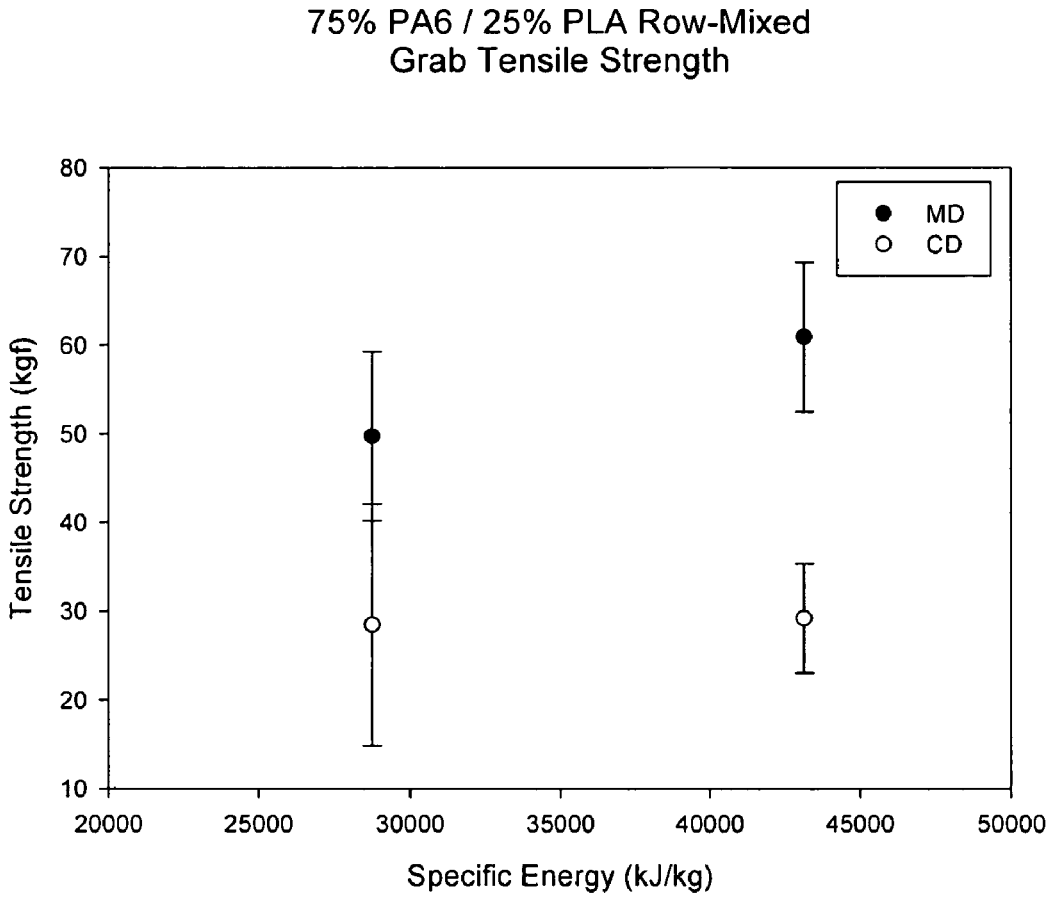
FIG. 19 is a graphical illustration of the grab tensile strength versus hydroentangling energy of a 75/25 PA6/PLA nonwoven fabric prepared according to one embodiment of the invention using a row-mixed spin-pack.
Figure 20:
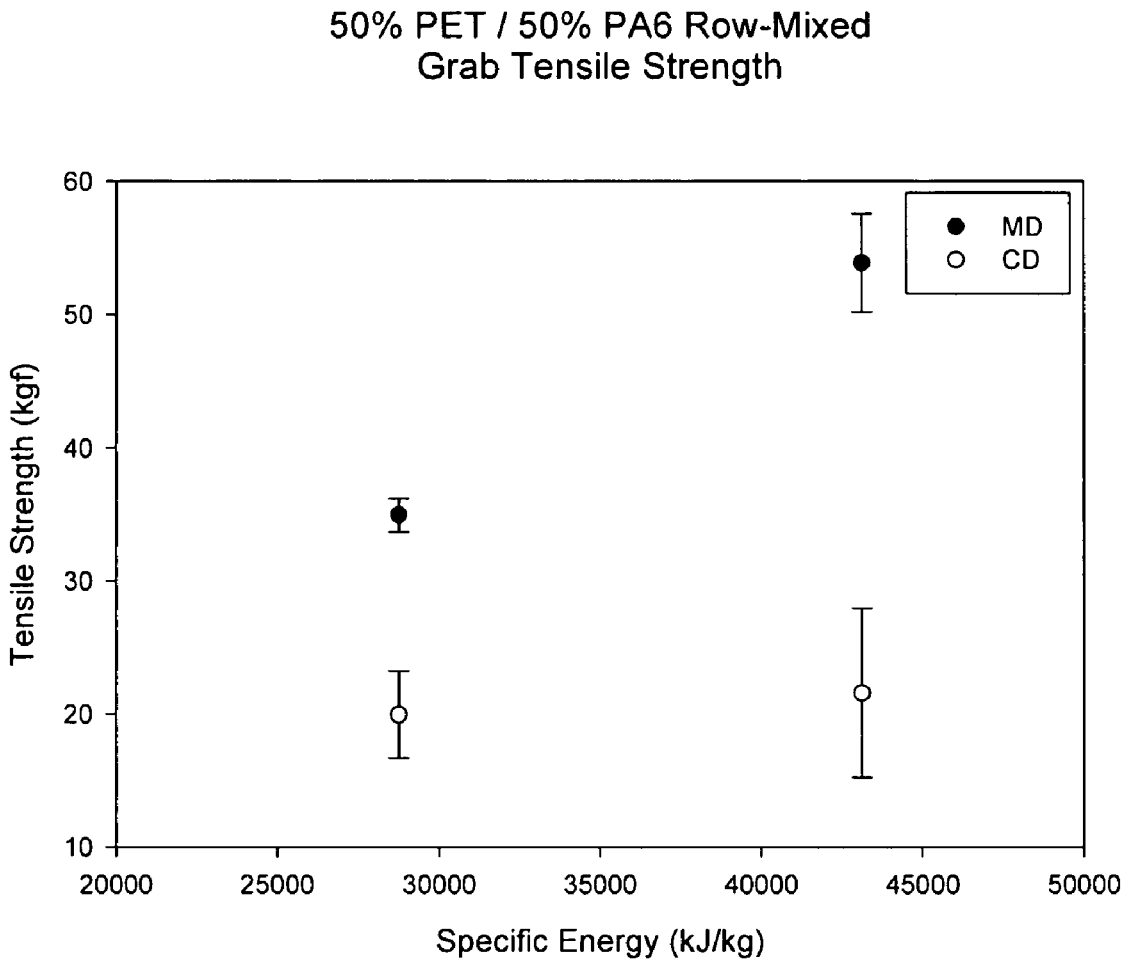
FIG. 20 is a graphical illustration of the grab tensile strength versus hydroentangling energy of a 50/50 PET/PA6 nonwoven fabric prepared according to one embodiment of the invention using a row-mixed spin-pack.
Figure 21:
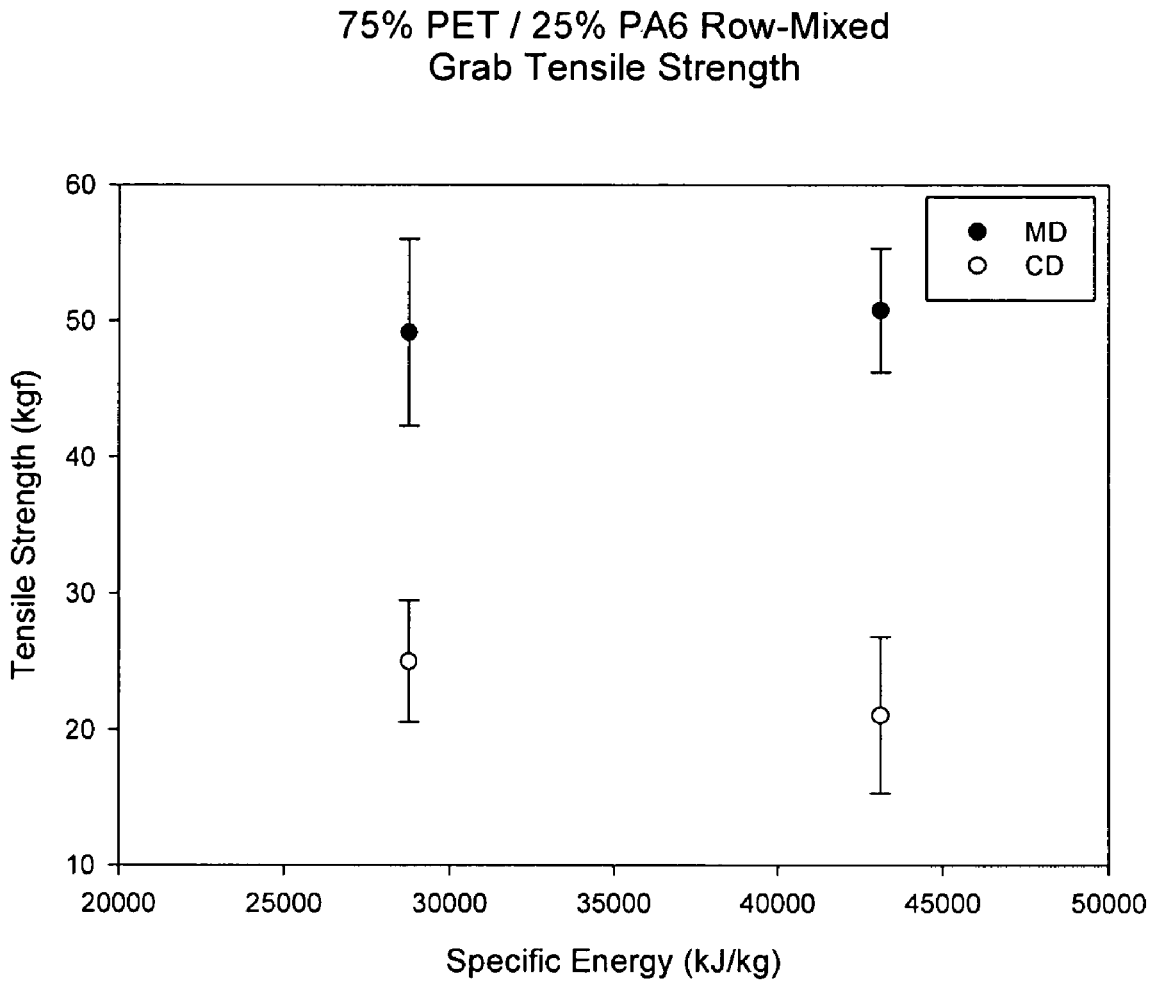
FIG. 21 is a graphical illustration of the grab tensile strength versus hydroentangling energy of a 75/25 PET/PA6 nonwoven fabric prepared according to one embodiment of the invention using a row-mixed spin-pack.
Figure 22:
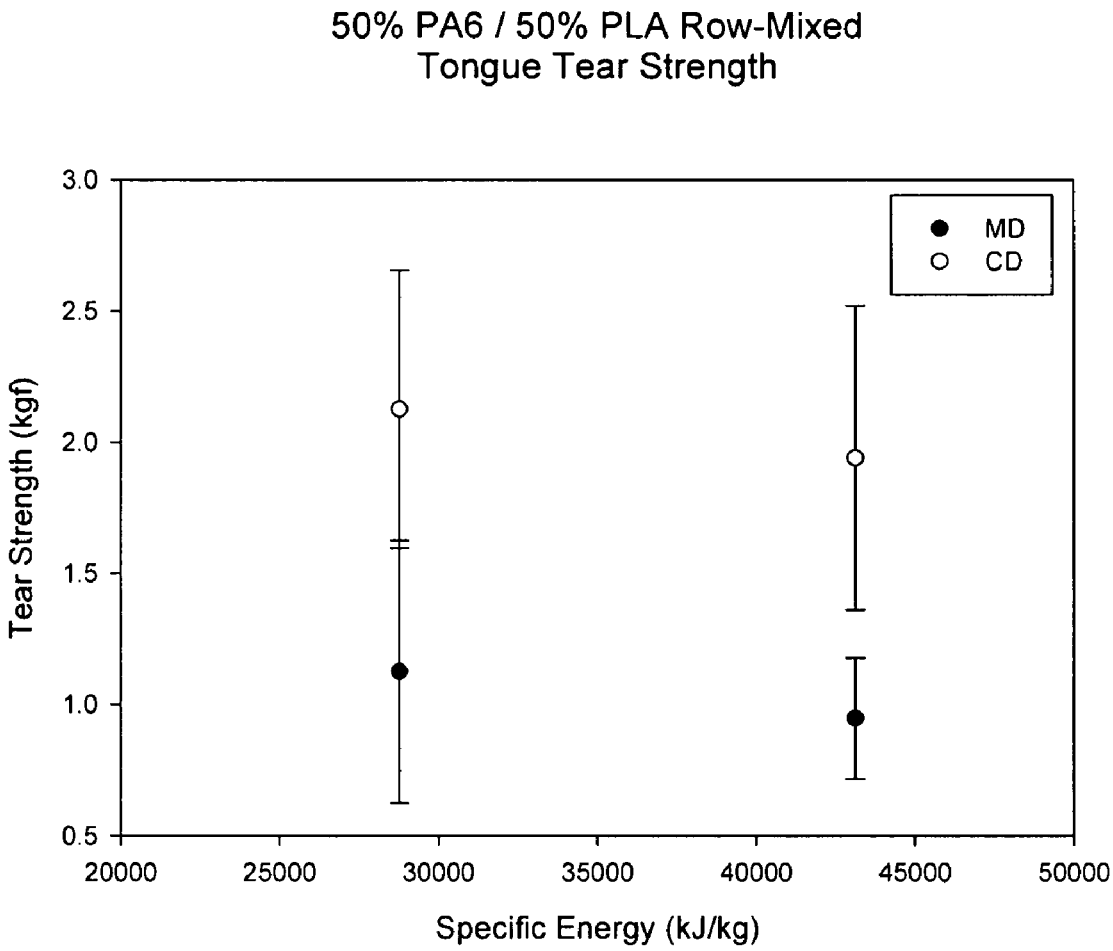
FIG. 22 is a graphical illustration of the tongue tear strength versus hydroentangling energy of a 50/50 PA6/PLA nonwoven fabric prepared according to one embodiment of the invention using a row-mixed spin-pack.
Figure 23:
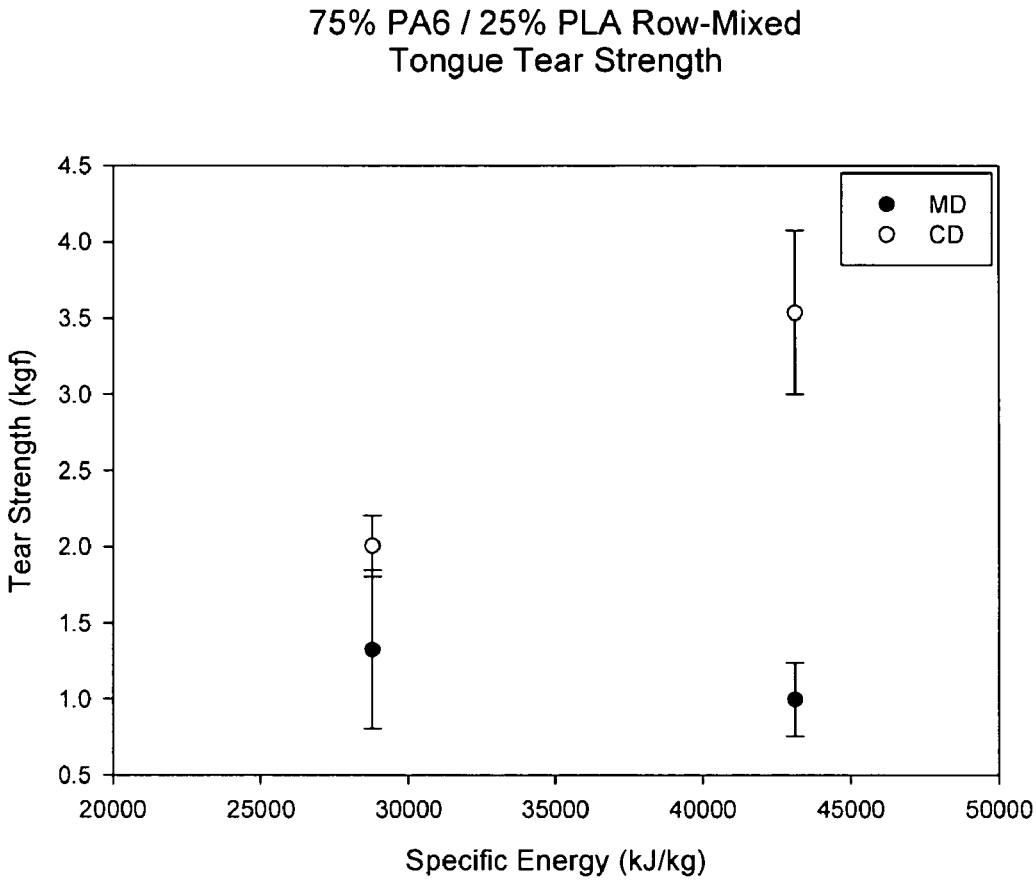
FIG. 23 is a graphical illustration of the tongue tear strength versus hydroentangling energy of a 75/25 PA6/PLA nonwoven fabric prepared according to one embodiment of the invention using a row-mixed spin-pack.
Figure 24:
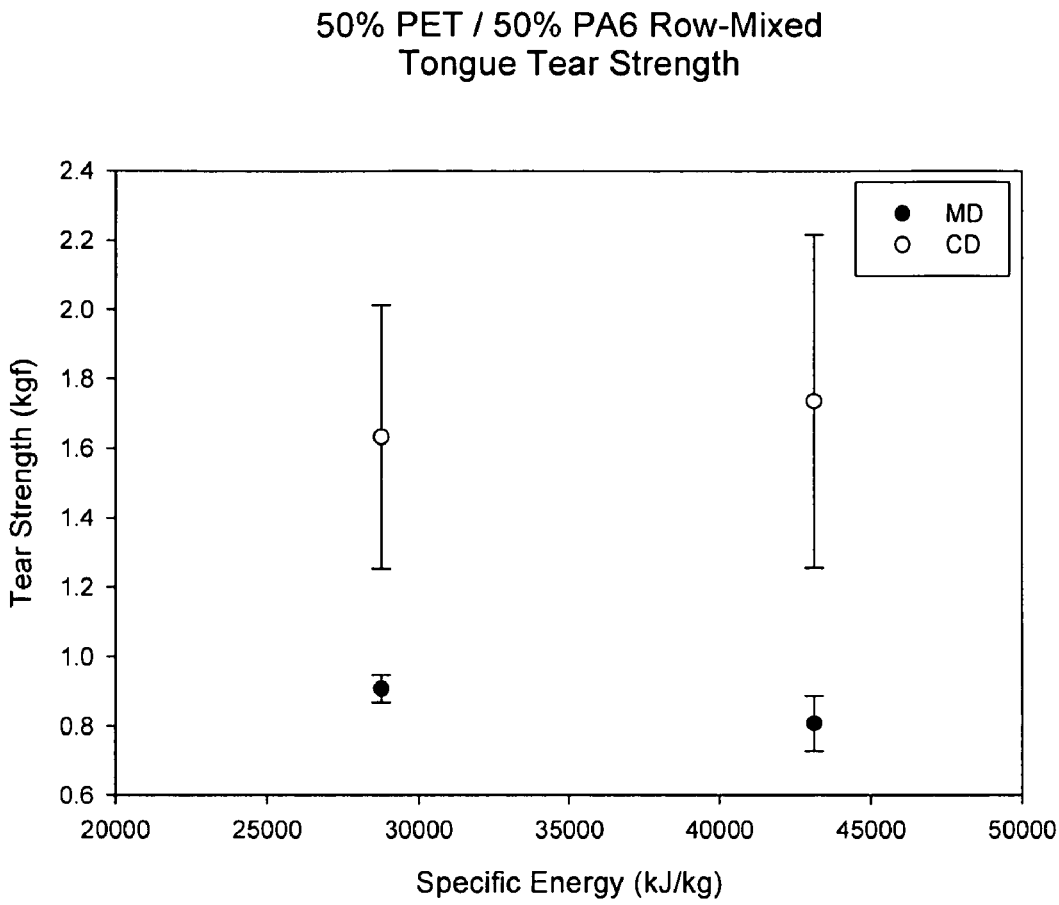
FIG. 24 is a graphical illustration of the tongue tear strength versus hydroentangling energy of a 50/50 PET/PA6 nonwoven fabric prepared according to one embodiment of the invention using a row-mixed spin-pack.
Figure 25:
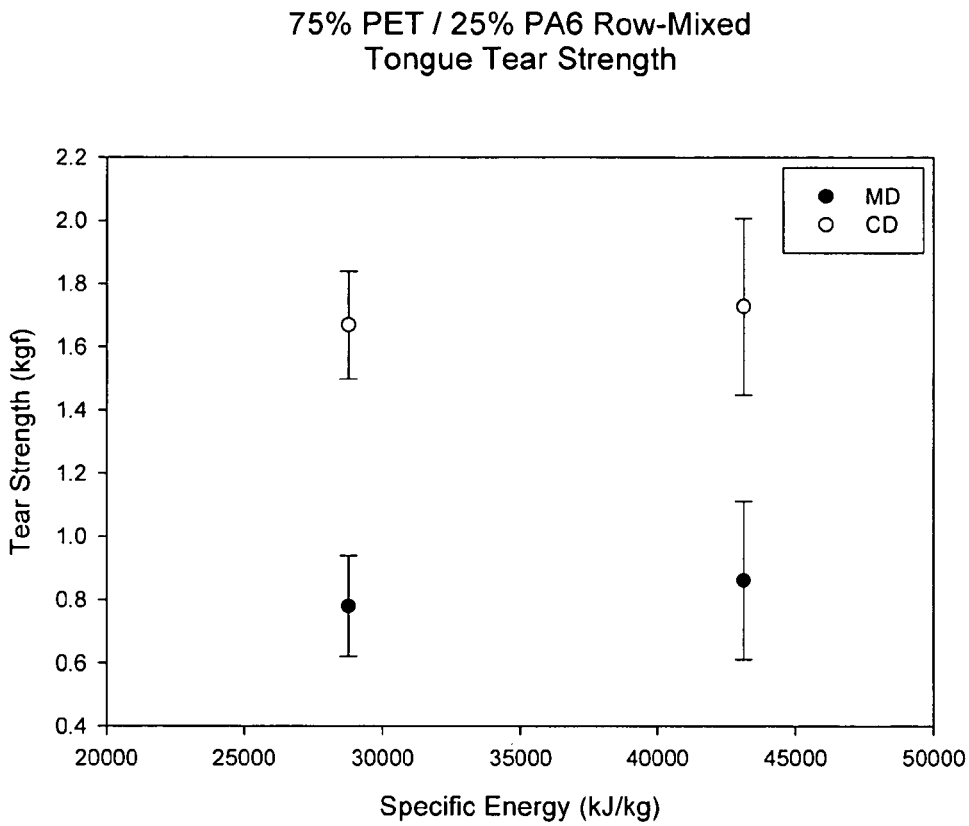
FIG. 25 is a graphical illustration of the tongue tear strength versus hydroentangling energy of a 75/25 PET/PA6 nonwoven fabric prepared according to one embodiment of the invention using a row-mixed spin-pack.
Figure 26:
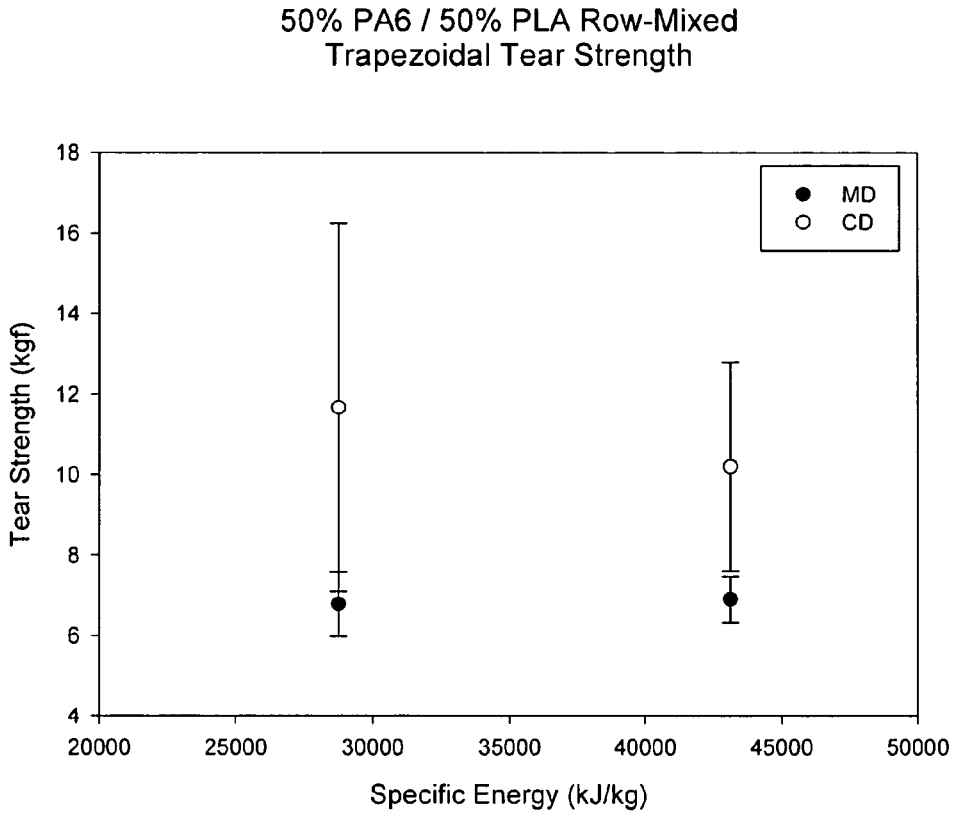
FIG. 26 is a graphical illustration of the trapezoidal tear strength versus hydroentangling energy of a 50/50 PA6/PLA nonwoven fabric prepared according to one embodiment of the invention using a row-mixed spin-pack.
Figure 27:
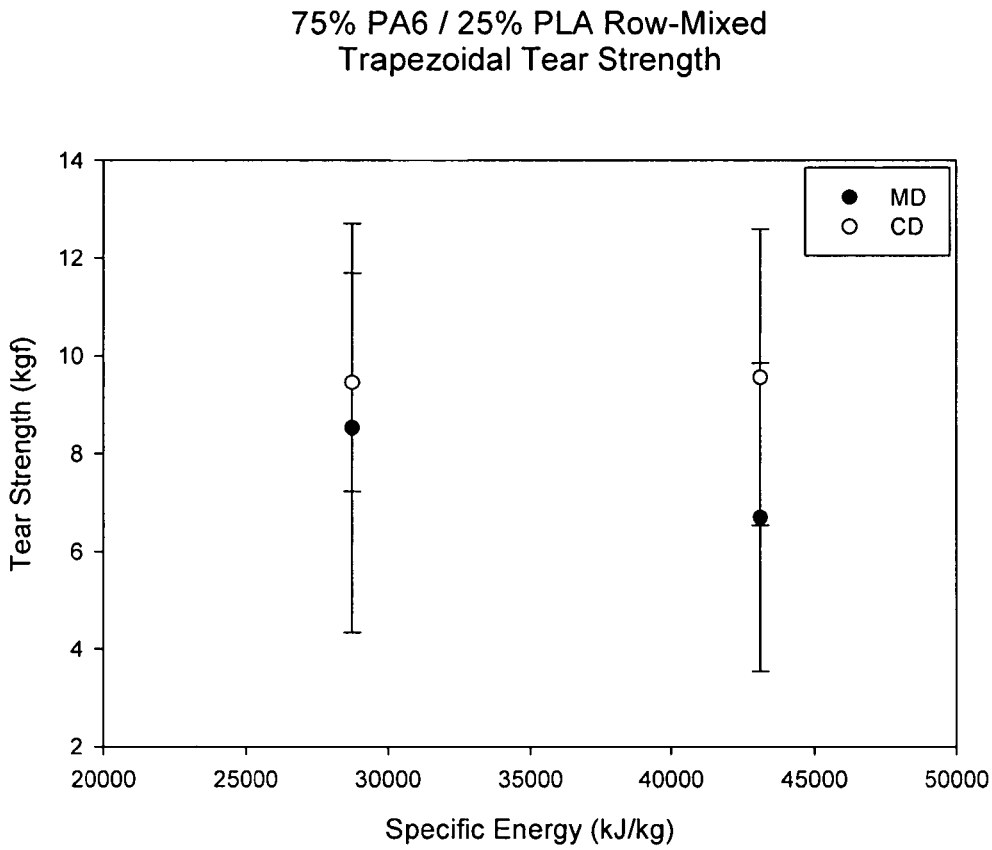
FIG. 27 is a graphical illustration of the trapezoidal tear strength versus hydroentangling energy of a 75/25 PA6/PLA nonwoven fabric prepared according to one embodiment of the invention using a row-mixed spin-pack.
Figure 28:
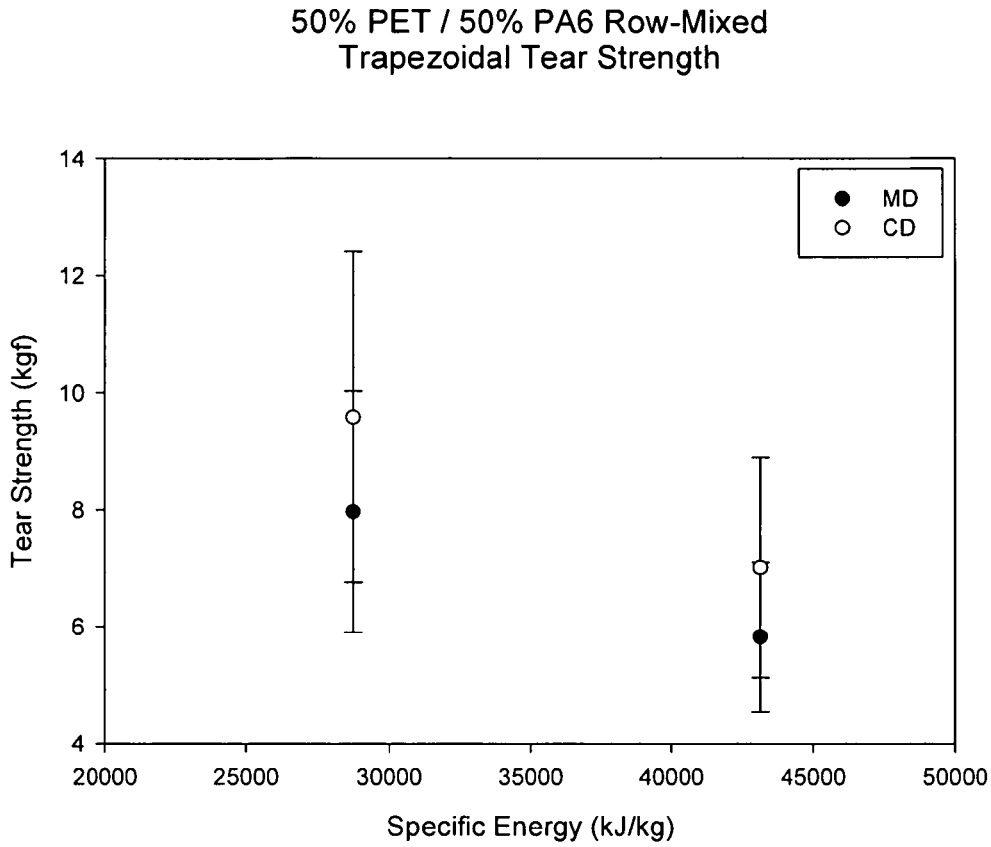
FIG. 28 is a graphical illustration of the trapezoidal tear strength versus hydroentangling energy of a 50/50 PET/PA6 nonwoven fabric prepared according to one embodiment of the invention using a row-mixed spin-pack.
Figure 29:
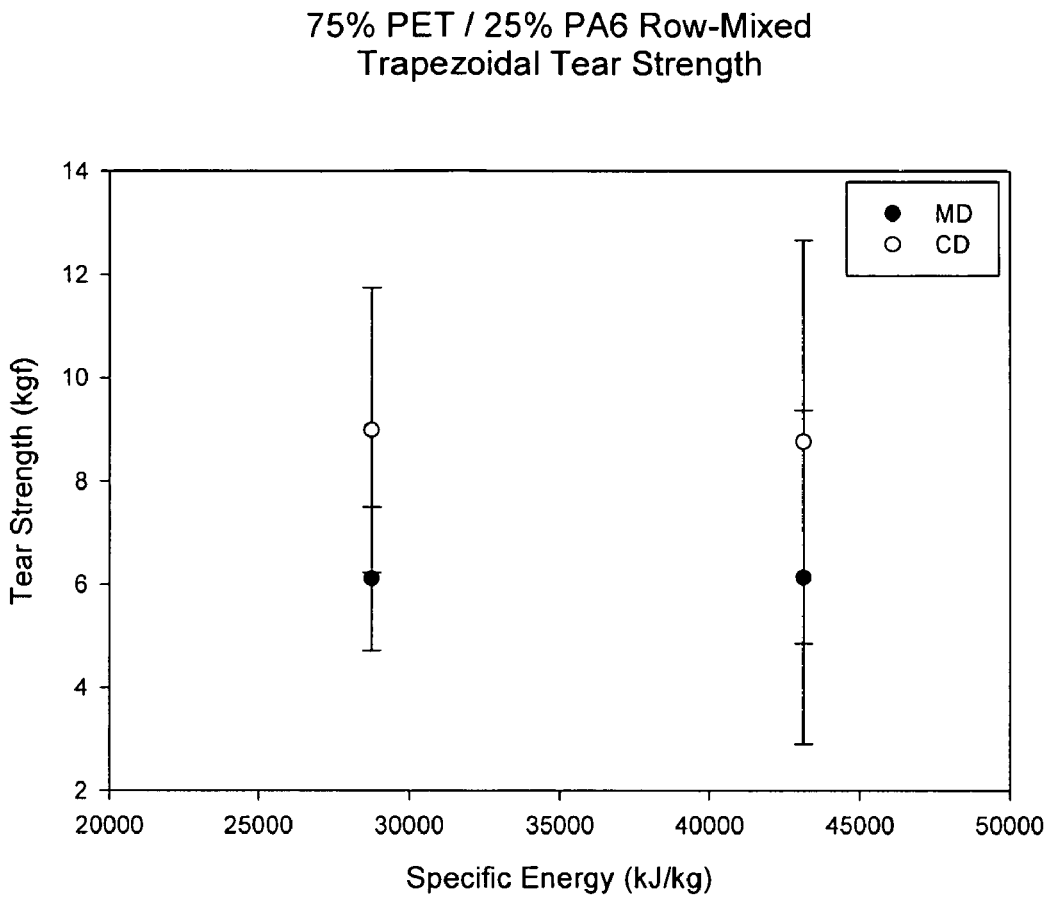
FIG. 29 is a graphical illustration of the trapezoidal tear strength versus hydroentangling energy of a 75/25 PET/PA6 nonwoven fabric prepared according to one embodiment of the invention using a row-mixed spin-pack.

Fabrics Prepared using Segmented Pie Bicomponent Fiber and Monocomponent Fiber with Row-Mixed Spin-Pack Design Nonwoven fabrics were prepared using pie/wedge bicomponent fibers having 16 segments per fiber combined with monocomponent fibers. Fabrics were subjected to hydroentangling and were prepared using either PA6 and PLA in defined ratios or polyethylene terephthalate (PET) and PA6 in defined ratios. In each case, the monocomponent filaments and the bicomponent filaments were extruded through the same spinneret having a pattern as illustrated in FIG. 17, wherein the open circles represent the orifices for spinning of monocomponent filaments, and the divided circles represent the orifices for spinning of bicomponent filaments. This design is referred to as a row-mixed spin-pack design.

Each fabric was formed to have a weight basis of 100 gsm and was tested for grab tensile strength, tongue tear strength, and trapezoidal tear strength using the methods described herein. The polymer compositions for each fabric, the treatment, and the tested properties are shown below in Tables 4, 5, and 6. Grab tensile strength, tongue tear strength, and trapezoidal tear strength for the fabrics are illustrated in FIGS. 18-29.

TABLE 4

| Polymers | Ratio | Mono-component Fiber | Hydro-entangling (passes) | Grab Tensile Strength MD Peak Load (kgf) | Grab Tensile Strength CD Peak Load (kgf) |
|---|---|---|---|---|---|
| PA6/PLA | 50/50 | PA6 | 2 | 44.5 | 22.5 |
| PA6/PLA | 50/50 | PA6 | 3 | 45.9 | 21.2 |
| PA6/PLA | 75/25 | PA6 | 2 | 49.7 | 28.5 |
| PA6/PLA | 75/25 | PA6 | 3 | 60.9 | 29.2 |
| PET/PA6 | 50/50 | PET | 2 | 34.9 | 20 |
| PET/PA6 | 50/50 | PET | 3 | 53.9 | 21.6 |
| PET/PA6 | 75/25 | PET | 2 | 49.2 | 25 |
| PET/PA6 | 75/25 | PET | 3 | 51 | 21.1 |

TABLE 5

| Polymers | Ratio | Mono-component Fiber | Hydro-entangling (passes) | Tongue Tear Strength MD Peak Load (kgf) | Tongue Tear Strength CD Peak Load (kgf) |
|---|---|---|---|---|---|
| PA6/PLA | 50/50 | PA6 | 2 | 1.1 | 2.1 |
| PA6/PLA | 50/50 | PA6 | 3 | 0.9 | 1.9 |
| PA6/PLA | 75/25 | PA6 | 2 | 1.3 | 2 |
| PA6/PLA | 75/25 | PA6 | 3 | 1 | 3.5 |
| PET/PA6 | 50/50 | PET | 2 | 0.9 | 1.6 |
| PET/PA6 | 50/50 | PET | 3 | 0.8 | 1.7 |
| PET/PA6 | 75/25 | PET | 2 | 0.8 | 1.7 |
| PET/PA6 | 75/25 | PET | 3 | 0.9 | 1.7 |

TABLE 6

| Polymers | Ratio | Mono-component Fiber | Hydro-entangling (passes) | Trapezoidal Tear Strength MD Peak Load (kgf) | Trapezoidal Tear Strength CD Peak Load (kgf) |
|---|---|---|---|---|---|
| PA6/PLA | 50/50 | PA6 | 2 | 6.8 | 11.7 |
| PA6/PLA | 50/50 | PA6 | 3 | 6.9 | 10.2 |
| PA6/PLA | 75/25 | PA6 | 2 | 8.5 | 9.5 |
| PA6/PLA | 75/25 | PA6 | 3 | 6.7 | 9.6 |
| PET/PA6 | 50/50 | PET | 2 | 8 | 9.6 |
| PET/PA6 | 50/50 | PET | 3 | 5.8 | 7.0 |
| PET/PA6 | 75/25 | PET | 2 | 6.1 | 9 |
| PET/PA6 | 75/25 | PET | 3 | 6.1 | 8.8 |

Example 3

Fabrics Prepared using Islands in the Sea Bicomponent Fiber and Monocomponent Fiber with Row-Mixed Spin-Pack Design Nonwoven fabrics were prepared using islands in the sea bicomponent fibers having 7 islands per fiber combined with monocomponent fibers. Fabrics were subjected to hydroentangling or calendaring and were prepared using: defined ratios of PET and PA6; defined ratios of PET and PLA; or defined ratios of PET and PE. In each case, the monocomponent filaments and the bicomponent filaments were extruded through the same spinneret having a row-mixed spin-pack design, as illustrated in FIG. 17.

Each fabric was formed to have a weight basis of 100 gsm and either hydroentangled or calendared. The fabrics were then tested for grab tensile strength, tongue tear strength, and trapezoidal tear strength using the methods described herein. The specific polymer compositions for each fabric, the treatment, and the tested properties are shown below in Tables 7, 8, 9, and 10. The fabrics in Tables 7, 8, and 9 were hydroentangled. The fabrics in Table 10 were thermally bonded

TABLE 7

| Polymers | Ratio | Mono-component Fiber | Hydro-entangling (passes) | Grab Tensile Strength MD Peak Load (kgf) | Grab Tensile Strength CD Peak Load (kgf) |
|---|---|---|---|---|---|
| PET/PA6 | 50/50 | PET | 1 | 34.8 | 21.2 |
| PET/PA6 | 50/50 | PET | 2 | 43.5 | 24 |
| PET/PA6 | 50/50 | PET | 3 | 43.6 | 22.7 |
| PET/PA6 | 50/50 | PET | 4 | 44.9 | 23.1 |
| PET/PA6 | 75/25 | PET | 1 | 38.5 | 21.4 |
| PET/PA6 | 75/25 | PET | 2 | 38.7 | 23.1 |
| PET/PA6 | 75/25 | PET | 3 | 50.1 | 24.8 |
| PET/PA6 | 75/25 | PET | 4 | 50 | 23.4 |
| PET/PLA | 50/50 | PET | 1 | 22.1 | 18.1 |
| PET/PLA | 50/50 | PET | 2 | 20.6 | 15.7 |
| PET/PLA | 50/50 | PET | 3 | 26.6 | 14.7 |
| PET/PLA | 50/50 | PET | 4 | 21.4 | 11.5 |
| PET/PLA | 75/25 | PET | 1 | 30.5 | 21.8 |
| PET/PLA | 75/25 | PET | 2 | 20.3 | 15.6 |
| PET/PLA | 75/25 | PET | 3 | 21.7 | 12.8 |
| PET/PLA | 75/25 | PET | 4 | 22.4 | 12.3 |
| PET/PE | 50/50 | PET | 1 | 20.5 | 13.6 |
| PET/PE | 50/50 | PET | 2 | 27.1 | 14.3 |
| PET/PE | 50/50 | PET | 3 | 27.7 | 14.2 |
| PET/PE | 50/50 | PET | 4 | 25.8 | 11.2 |
| PET/PE | 75/25 | PET | 1 | 22.1 | 27.3 |
| PET/PE | 75/25 | PET | 2 | 51.4 | 22.8 |
| PET/PE | 75/25 | PET | 3 | 54.5 | 23.7 |
| PET/PE | 75/25 | PET | 4 | 47.1 | 19.3 |

TABLE 8

| Polymers | Ratio | Mono-component Fiber | Hydro-entangling (passes) | Tongue Tear Strength MD Peak Load (kgf) | Tongue Tear Strength CD Peak Load (kgf) |
|---|---|---|---|---|---|
| PET/PA6 | 50/50 | PET | 1 | 2.6 | 4 |
| PET/PA6 | 50/50 | PET | 2 | 2 | 3.5 |
| PET/PA6 | 50/50 | PET | 3 | 1.6 | 2.9 |
| PET/PA6 | 50/50 | PET | 4 | 1.8 | 2.6 |
| PET/PA6 | 75/25 | PET | 1 | 3.7 | 4.6 |
| PET/PA6 | 75/25 | PET | 2 | 2.7 | 4.1 |
| PET/PA6 | 75/25 | PET | 3 | 2.2 | 3.7 |
| PET/PA6 | 75/25 | PET | 4 | 1.8 | 3.5 |
| PET/PLA | 50/50 | PET | 1 | 1.2 | 2.1 |
| PET/PLA | 50/50 | PET | 2 | 1.4 | 2.4 |
| PET/PLA | 50/50 | PET | 3 | 1.5 | 2.4 |
| PET/PLA | 50/50 | PET | 4 | 1.4 | 2.1 |
| PET/PLA | 75/25 | PET | 1 | 1.7 | 2.7 |
| PET/PLA | 75/25 | PET | 2 | 1.3 | 1.6 |
| PET/PLA | 75/25 | PET | 3 | 1.2 | 2.0 |
| PET/PLA | 75/25 | PET | 4 | 1.2 | 2.3 |
| PET/PE | 50/50 | PET | 1 | 3.7 | 3.6 |
| PET/PE | 50/50 | PET | 2 | 2.4 | 3.5 |
| PET/PE | 50/50 | PET | 3 | 2 | 3.3 |
| PET/PE | 50/50 | PET | 4 | 1.7 | 2.8 |
| PET/PE | 75/25 | PET | 1 | 5.6 | 4.4 |
| PET/PE | 75/25 | PET | 2 | 4.4 | 5.1 |
| PET/PE | 75/25 | PET | 3 | 2.9 | 5.2 |
| PET/PE | 75/25 | PET | 4 | 2.4 | 4.0 |

TABLE 9

| Polymers | Ratio | Mono-component Fiber | Hydro-entangling (passes) | Trapezoidal Tear Strength MD Peak Load (kgf) | Trapezoidal Tear Strength CD Peak Load (kgf) |
|---|---|---|---|---|---|
| PET/PA6 | 50/50 | PET | 1 | 8.2 | 11.5 |
| PET/PA6 | 50/50 | PET | 2 | 7.1 | 11.2 |
| PET/PA6 | 50/50 | PET | 3 | 7.8 | 12.4 |
| PET/PA6 | 50/50 | PET | 4 | 10.3 | 13.7 |
| PET/PA6 | 75/25 | PET | 1 | 9.7 | 13.6 |
| PET/PA6 | 75/25 | PET | 2 | 9.3 | 14.3 |
| PET/PA6 | 75/25 | PET | 3 | 9.7 | 12.8 |
| PET/PA6 | 75/25 | PET | 4 | 8.8 | 11.7 |
| PET/PLA | 50/50 | PET | 1 | 3.6 | 3.7 |
| PET/PLA | 50/50 | PET | 2 | 4.3 | 4.2 |
| PET/PLA | 50/50 | PET | 3 | 4.4 | 6.1 |
| PET/PLA | 50/50 | PET | 4 | 4.5 | 7.8 |
| PET/PLA | 75/25 | PET | 1 | 6.9 | 9.5 |
| PET/PLA | 75/25 | PET | 2 | 3.8 | 5.1 |
| PET/PLA | 75/25 | PET | 3 | 4.5 | 7.7 |
| PET/PLA | 75/25 | PET | 4 | 4.4 | 5.7 |
| PET/PE | 50/50 | PET | 1 | 6.1 | 8.2 |
| PET/PE | 50/50 | PET | 2 | 5.4 | 8.8 |
| PET/PE | 50/50 | PET | 3 | 5.9 | 8.8 |
| PET/PE | 50/50 | PET | 4 | 5.8 | 10.4 |
| PET/PE | 75/25 | PET | 1 | 12.1 | 13.1 |
| PET/PE | 75/25 | PET | 2 | 11.1 | 16 |
| PET/PE | 75/25 | PET | 3 | 10.8 | 14.6 |
| PET/PE | 75/25 | PET | 4 | 10.2 | 16.9 |

TABLE 10

| Polymers | Ratio | Mono-component Fiber | Calendaring Temp. (° C.) | Trapezoidal Tear Strength MD Peak Load (kgf) | Trapezoidal Tear Strength CD Peak Load (kgf) |
|---|---|---|---|---|---|
| PE/PA6 | 50/50 | PE | 130 | 6.7 | 7.0 |
| PE/PA6 | 50/50 | PE | 140 | 8.6 | 6.9 |
| PE/PA6 | 50/50 | PE | 150 | 8.5 | 12 |
| PE/PA6 | 50/50 | PE | 160 | 7.6 | 12.4 |

Example 4

Aerosol Filtration

Figure 30:
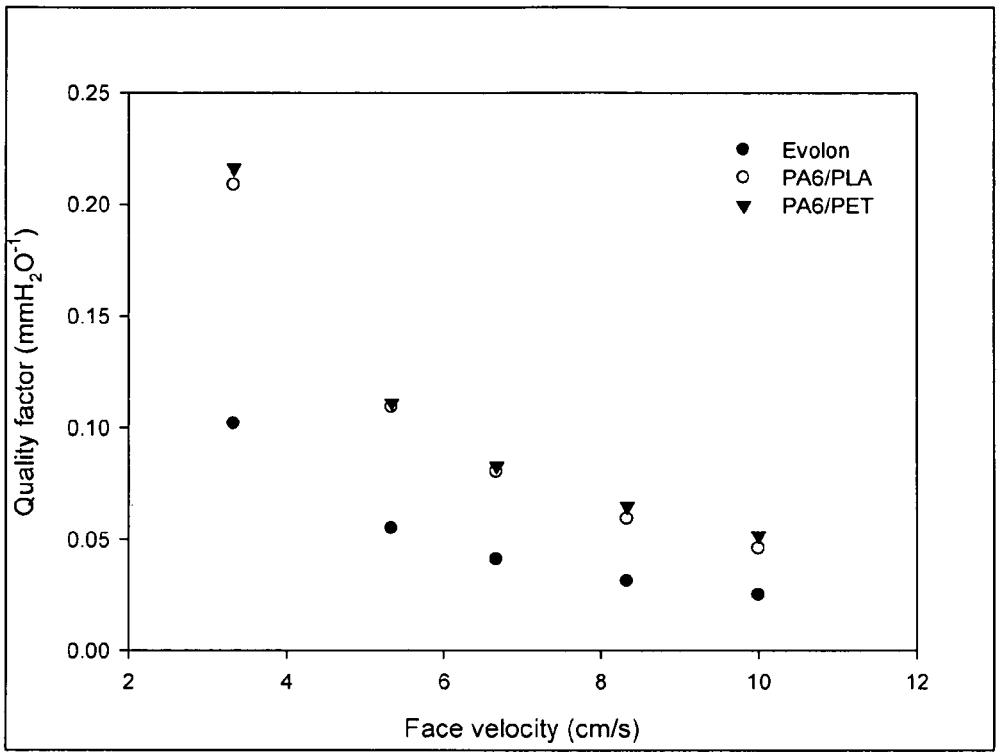
FIG. 30 is a graph illustrating quality factor (QF) in relation to face velocity of three fabrics tested for aerosol filtration.

Nonwoven fabrics were prepared using pie/wedge bicomponent fibers having 16 segments per fiber combined with monocomponent fibers and were subjected to hydroentangling. Test fabric 1 was formed of a 50/50 PA6/PLA bicomponent fiber and a PA6 monocomponent fiber. Test fabric 2 was formed of a 50/50 PA6/PET bicomponent fiber and a PA6 monocomponent fiber. Each test fabric was formed to have a 100 gsm basis weight using a row-mixed spin pack design. As a comparative, testing was also performed on an EVOLON® fabric having a basis weight of 135 gsm. Aerosol filtration performance was evaluated to determine penetration, efficiency, and resistance, and these values were used to calculate the quality factor (QF) for each fabric. Testing was performed as face velocities between 3.3 and 10.0 cm/s using a TSI automated filter tester (Model 3160). Dioctyl phthalate (DOP) oils with 0.3 μm size aerosolized particles was used as the challenging aerosol. Calculated QF values are shown below in Table 11. The values are graphically represented in FIG. 30.

TABLE 11

| Face Velocity | Quality Factor ($mmH_2O^{-1}$) | | |
|---|---|---|---|
| (cm/s) | EVOLON ® | 50/50 PA6/PLA | 50/50 PA6/PET |
| 3.3 | 0.10 | 0.21 | 0.22 |
| 5.3 | 0.05 | 0.11 | 0.11 |
| 6.7 | 0.04 | 0.08 | 0.08 |
| 8.3 | 0.03 | 0.06 | 0.06 |
| 10.0 | 0.02 | 0.05 | 0.05 |

TABLE 12

| Face Velocity | Resistance (psi) | | |
|---|---|---|---|
| (cm/s) | EVOLON ® | 50/50 PA6/PLA | 50/50 PA6/PET |
| 0.04 | 0.03 | 0 | 0 |
| 0.09 | 0.08 | 0.01 | 0.02 |
| 0.13 | 0.11 | 0.02 | 0.03 |
| 0.17 | 0.15 | 0.04 | 0.05 |
| 0.22 | 0.18 | 0.04 | 0.06 |

Example 5

Liquid Filtration

Nonwoven fabrics were prepared using pie/wedge bicomponent fibers having 16 segments per fiber combined with monocomponent fibers and were subjected to hydroentangling. Test fabric 1 was formed of a 50/50 PA6/PLA bicomponent fiber and a PA6 monocomponent fiber. Test fabric 2 was formed of a 50/50 PA6/PET bicomponent fiber and a PA6 monocomponent fiber. Each test fabric was formed to have a 100 gsm basis weight using a row-mixed spin pack design. As a comparative, testing was also performed on an EVOLON® fabric having a basis weight of 135 gsm.

Figure 31:
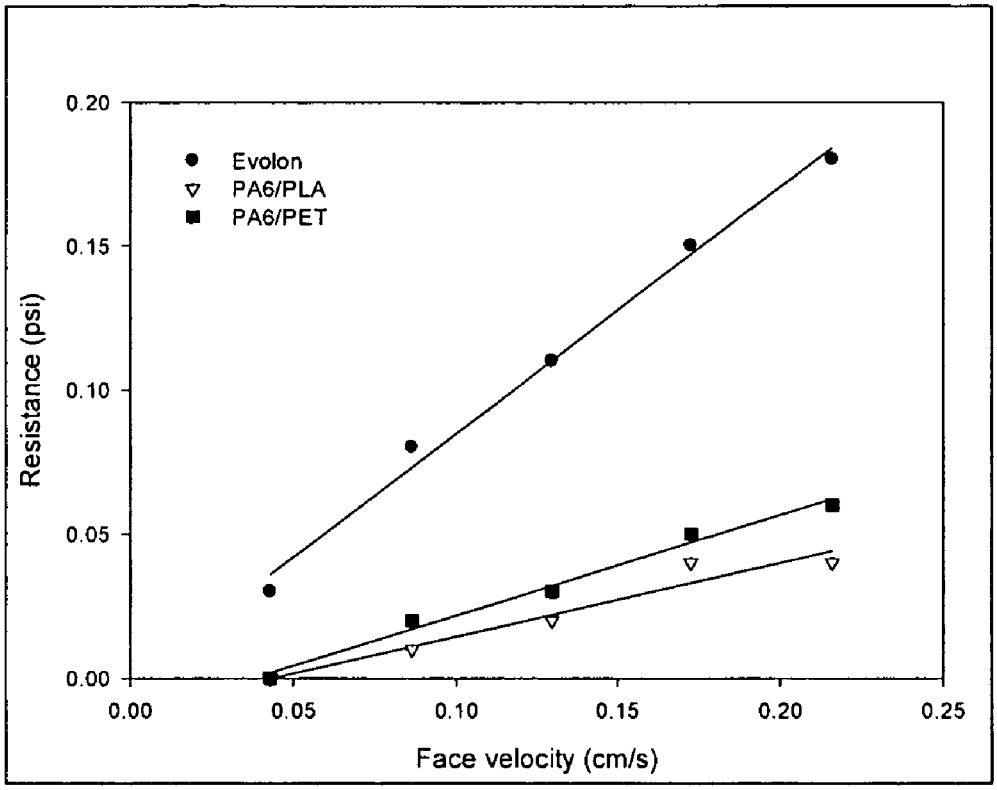
FIG. 31 is a graph illustrating flow resistance as a factor of face velocity for three fabrics tested for liquid filtration.
Figure 32:
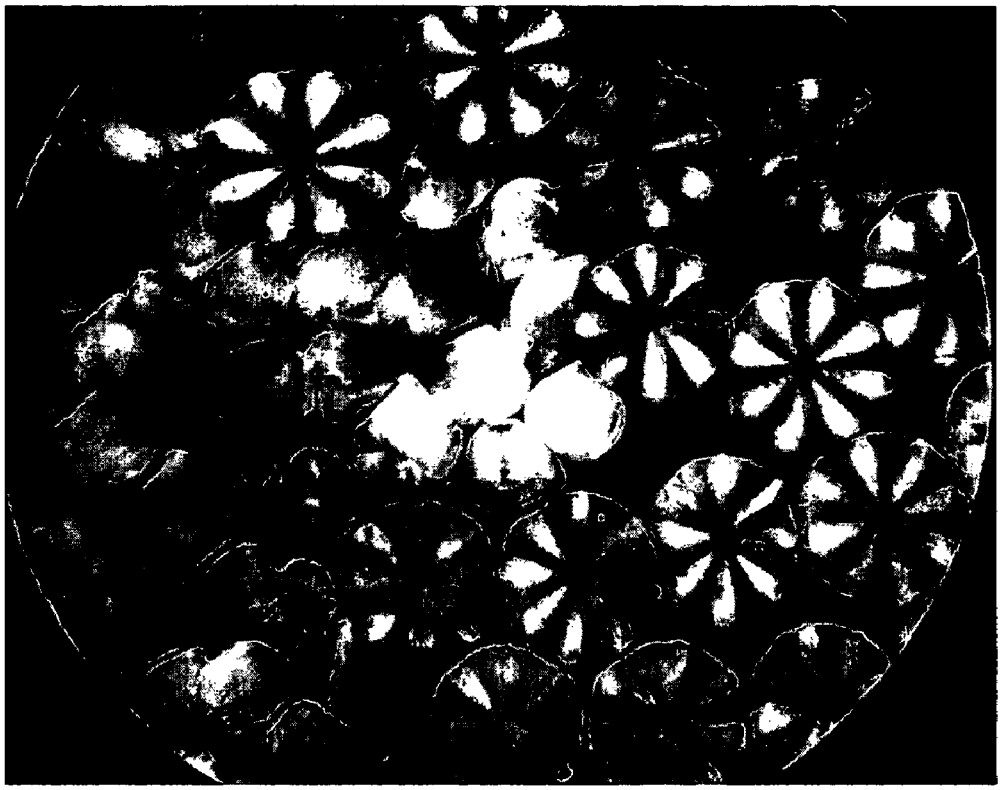
FIG. 32 is a scanning electron micrograph (SEM) image of a cross-section from a fabric prepared using a 50/50 mix of polyamide 6 (PA6) and polylactic acid (PLA) by simultaneously extruding monocomponent fibers of PA6 and pie/wedge bicomponent fibers having 16 segments per fiber and being formed of PA6 and PLA using a row-mixed spin-pack design.
Figure 33:
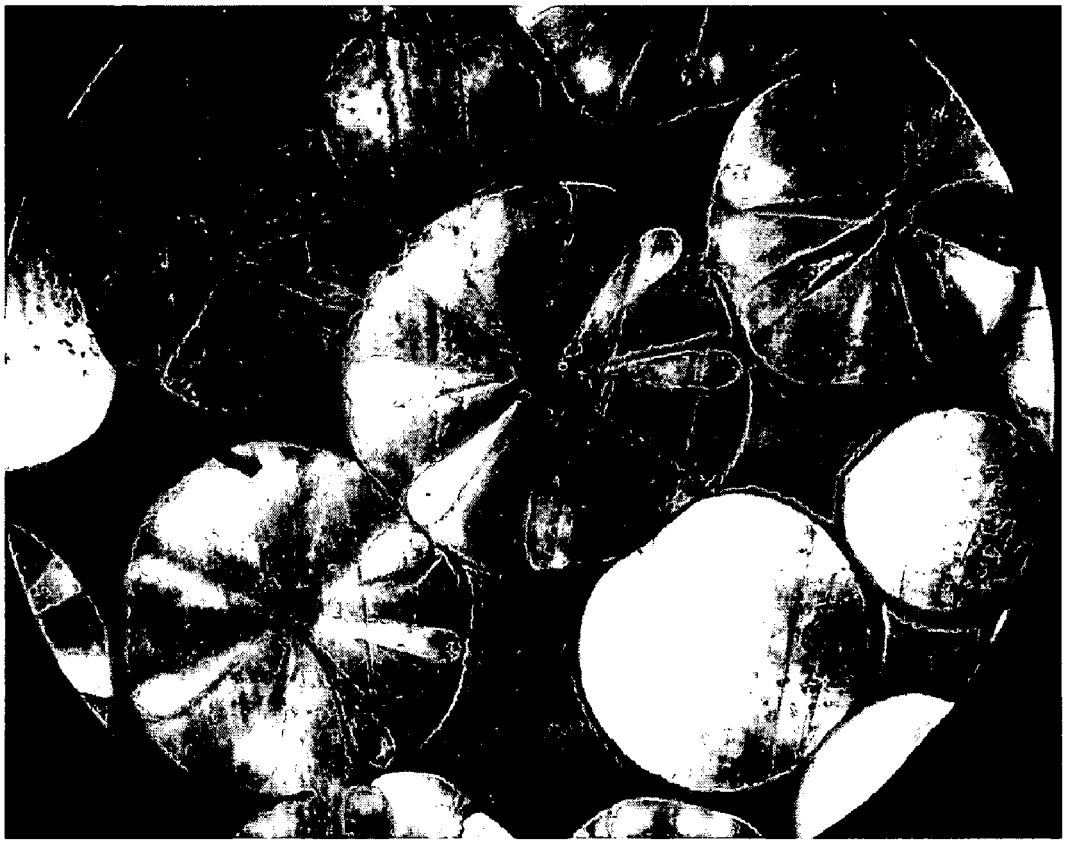
FIG. 33 is a scanning electron micrograph (SEM) image of a cross-section from a fabric prepared using a 50/50 mix of PA6 and PLA by simultaneously extruding monocomponent fibers of PA6 and pie/wedge bicomponent fibers having 16 segments per fiber and being formed of PA6 and PLA using a mixed-alternate spin-pack design.
Figure 34:
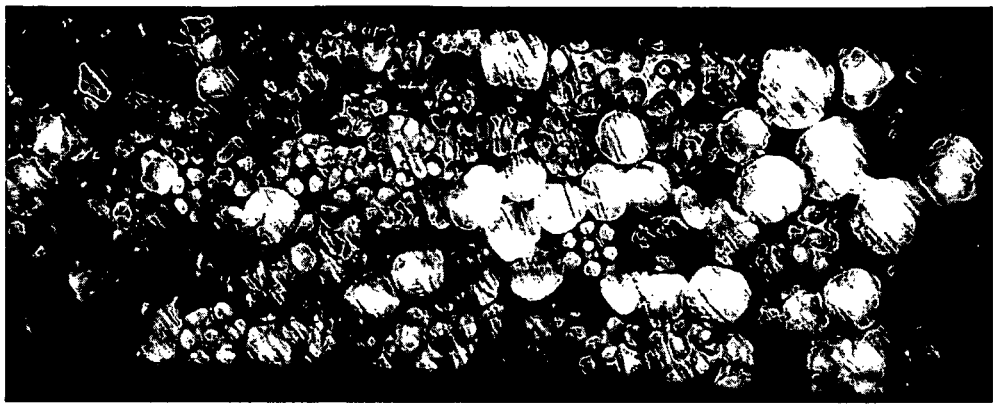
FIG. 34 is a scanning electron micrograph (SEM) image of a cross-section from a fabric prepared using a 75/25 mix of polyethylene terephthalate (PET) and PA6 by simultaneously extruding monocomponent fibers of PET and islands in the sea fibers having 7 islands per fiber and being formed of PET and PLA using a mixed-alternate spin-pack design.
Figure 35:
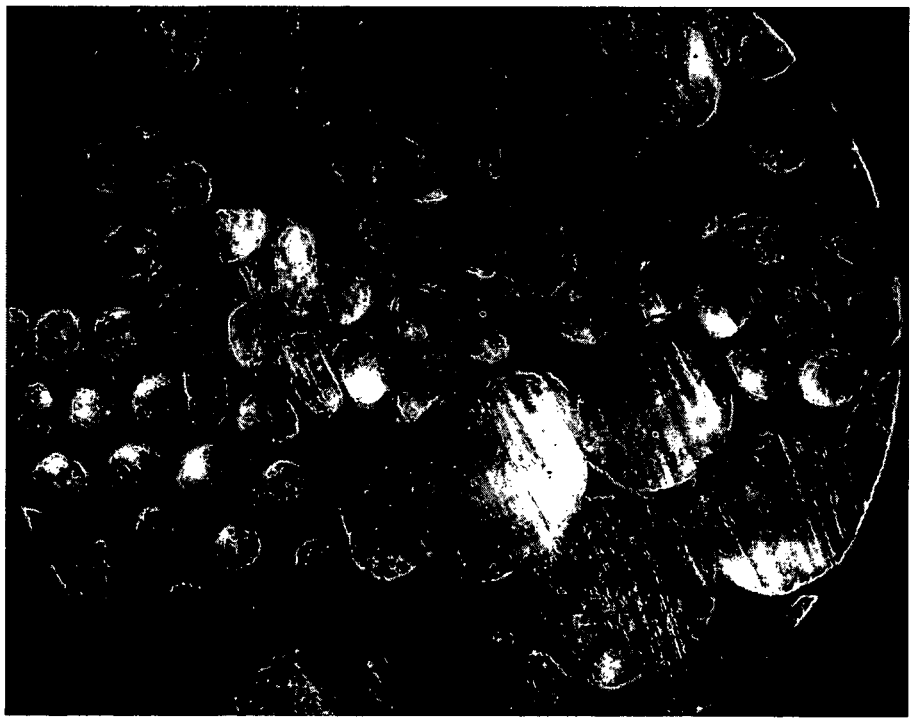
FIG. 35 is an SEM image providing a magnified view of the cross-section of fibers shown in FIG. 34.

Liquid filtration performance was evaluated using SILCO-SIL® 106 in deionized water. Initial particulate concentration was measured using a Hach turbidimeter. Flow resistance of the filter media was measured at face velocities between 0.04 and 0.22 cm/s. Final particulate concentration was measured after flowing the liquid with the particulate matter therein through the test fabric. Efficiency values for the test fabrics were calculated 71.7% (50/50 PA6/PLA), 69.5% (50/50 PA6/PLA), and 80.3% (EVOLON®). The efficiency value for the EVOLON® fabric reflects the closed structure of the fibers. In other words, the EVOLON® fabric tends to "catch" particles on the face of the fabric rather than trapping particles within the fabric. The more "open" structure of the inventive fabrics, however, is reflected by the excellent resistance values (as low as zero at a face velocity of 0.04 cm/s) shown in Table 12 and FIG. 31. Thus, a filter formed of the EVOLON® fabric would be expected to "clog" and limit flow much quicker than a filter formed of an inventive fabric. Further, the fabrics of the invention provide excellent (i.e., low) resistance values while providing overall efficiency that is comparable to the EVOLON® fabric.

Example 6

Air Permeability

Nonwoven fabrics were prepared using pie/wedge bicomponent fibers having 16 segments per fiber combined with monocomponent fibers. Fabrics were subjected to hydroentangling and were prepared using bicomponent fibers of PA6 and PLA and monocomponent fibers of PA6 or bicomponent fibers of PET and PA6 and monocomponent fibers of PET by extruding through a spinneret using a row-mixed spin pack design or a mixed-alternate spin pack design. Each fabric was formed to have a weight basis of 100 gsm. Nonwoven fabrics also were prepared using islands in the sea bicomponent fibers having 7 islands per fiber combined with monocomponent fibers. Fabrics were subjected to hydroentangling and were prepared using bicomponent fibers of PA6 and PLA and monocomponent fibers of PA6 or bicomponent fibers of PET and PA6 and monocomponent fibers of PET. In each case, the monocomponent filaments and the bicomponent filaments were extruded through the same spinneret having a mixed-alternate spin-pack design. Each fabric was formed to have a weight basis of 100 gsm. As a comparative, testing was also performed on an EVOLON® fabric having a basis weight of 135 gsm. The above fabrics were tested according to ASTM D 737-04. Test results are provided below in Table 13.

TABLE 13

| Polymers | Ratio | Type | Bicomponent Cross-Section | Hydroentangling Passes | Permeability ($ft^3/ft^2$ min) |
|---|---|---|---|---|---|
| PA6/PLA | 75/25 | Row-Mixed | 16 Segmented-Pie | 3 | 19.88 |
| PA6/PLA | 50/50 | Row-Mixed | 16 Segmented-Pie | 3 | 19.81 |
| PA6/PLA | 75/25 | Mixed-Alternate | 16 Segmented-Pie | 3 | 18.19 |
| PA6/PLA | 50/50 | Mixed-Alternate | 16 Segmented-Pie | 3 | 23.67 |
| PET/PA6 | 75/25 | Row-Mixed | 16 Segmented-Pie | 3 | 19.95 |
| PET/PA6 | 50/50 | Row-Mixed | 16 Segmented-Pie | 3 | 21.17 |
| PET/PA6 | 75/25 | Row-Mixed | 16 Segmented-Pie | 4 | 10.98 |
| PET/PA6 | 50/50 | Row-Mixed | 16 Segmented-Pie | 4 | 11.14 |
| PA6/PLA | 75/25 | Mixed-Alternate | 7 Islands-in-the-Sea | 4 | 92.94 |
| PA6/PLA | 50/50 | Mixed-Alternate | 7 Islands-in-the-Sea | 4 | 98.11 |
| PET/PA6 | 75/25 | Mixed-Alternate | 7 Islands-in-the-Sea | 4 | 47.07 |
| PET/PA6 | 50/50 | Mixed-Alternate | 7 Islands-in-the-Sea | 4 | 32.17 |
| EVOLON ® | 70/30 | Regular | Segmented Pie | — | 5.64 |

Scanning electron micrograph (SEM) images of several fabrics as described in the foregoing examples are provided in FIGS. 32-35. Each image is a cross section of the various fibers clearly showing the presence of the bicomponent fibers and the monocomponent fibers. These images illustrate how the present invention is useful for preparing mixed media, nonwoven fabrics since the monocomponent fibers provide a greater resistivity to compression and the bicomponent fibers, once split (in segmented configurations) or having undergone removal of a sea component (in I/S configurations), result in very fine fibers that provide excellent loft and insulating properties.

Many modifications and other embodiments of the inventions set forth herein will come to mind to one skilled in the art to which these inventions pertain having the benefit of the teachings presented in the foregoing description. Therefore, it is to be understood that the inventions are not to be limited to the specific embodiments disclosed and that modifications and other embodiments are intended to be included within the scope of the invention. Although specific terms are employed herein, they are used in a generic and descriptive sense only and not for purposes of limitation.

That which is claimed:

1. A method of producing a nonwoven fabric, comprising:

simultaneously melt spinning a set of fibers comprising a first fiber type and a second fiber type, the first fiber type comprising an islands in the sea fiber formed with a soluble sea component that dissolves to release a plurality of island filaments each less than about 1 denier in size, the second fiber type comprising at least one fiber that is greater than about 1 denier in size; and collecting the melt-spun set of fibers.

2. The method of claim 1, wherein the second fiber type comprises a bicomponent fiber.

3. The method of claim 2, wherein the bicomponent fiber is a segmented fiber that disassociates into a plurality of individual segments.

4. The method of claim 3, wherein each individual segment of the segmented fiber is greater than about 1 denier in size.

5. The method of claim 3, wherein each individual segment of the segmented fiber has a filament diameter of at least about 2 μm.

6. The method of claim 1, wherein the second fiber type comprises a monocomponent fiber.

7. The method of claim 6, wherein the monocomponent fiber has a diameter of at least about 5 μm.

8. The method of claim 6, wherein the fabric comprises at least about 20% by weight of the monocomponent fiber based on the overall weight of the fabric.

9. The method of claim 1, wherein each of the plurality of island filaments has a diameter of less than about 1 μm.

10. The method of claim 9, wherein each of the plurality of island filaments has a diameter of about 0.2 μm to about 0.8 μm.

11. The method of claim 1, wherein the second fiber type comprises an islands in the sea fiber formed with a soluble sea component that dissolves to release a plurality of island filaments each having a size that is greater than the size of the filaments from the first fiber type.

12. The method of claim 11, wherein the islands in the sea fiber of the first fiber type comprises a greater number of islands than the islands in the sea fiber of the second fiber type.

13. The method of claim 12, wherein the number of islands in the first and second fiber types are present at a ratio of at least 2:1.

14. The method of claim 12, wherein the number of islands in the first and second fiber types are present at a ratio of at least 10:1.

15. The method of claim 1, further comprising forming the melt-spun set of fibers into a nonwoven fiber web.

16. The method of claim 15, further comprising mechanically bonding, thermally bonding, or both mechanically and thermally bonding the nonwoven fiber web.

17. The method of claim 1, wherein said melt spinning comprises extruding through a spinneret configured to arrange the first fiber type and the second fiber type in rows, each row containing only fibers of a single type.

18. The method of claim 17, wherein the fibers of the second type are in the middle of two layers of fibers of the first type.

19. The method of claim 17, wherein the fibers of the first type are in the middle of two layers of fibers of the second type.

20. The method of claim 1, where said melt spinning comprises extruding through a spinneret configured to arrange the first fiber type and the second fiber type in a random configuration.

21. The method of claim 1, wherein the second fiber type comprises at least about 20% by weight of the total weight of the melt-spun fibers.

22. A method of producing a nonwoven fabric, comprising:

simultaneously melt spinning a set of fibers comprising a first fiber type and at least about 20% by weight of a second fiber type, the first fiber type comprising a bicomponent fiber formed to provide a plurality of individual filaments less than about 1 denier in size by splitting or fibrillating or by dissolving one component of the bicomponent fiber, the second fiber type comprising at least one fiber that is greater than about 1 denier in size; and collecting the melt-spun set of fibers.

23. The method of claim 22, wherein the second fiber type comprises a monocomponent fiber.

24. The method of claim 22, wherein the first fiber type comprises an islands in the sea fiber.

25. The method of claim 22, wherein the first fiber type comprises a segmented fiber.

* * * * *